US006580374B2

(12) United States Patent
Schrage

(10) Patent No.: US 6,580,374 B2
(45) Date of Patent: Jun. 17, 2003

(54) AUDIBLE COMMUNICATION SYSTEM

(76) Inventor: Martin H. Schrage, 20 Hamilton Rd., Arlington, MA (US) 02474

( * ) Notice: Subject to any disclaimer, the term of this patent is extended or adjusted under 35 U.S.C. 154(b) by 0 days.

(21) Appl. No.: 09/921,591

(22) Filed: Aug. 3, 2001

(65) Prior Publication Data

US 2002/0101360 A1 Aug. 1, 2002

Related U.S. Application Data

(60) Provisional application No. 60/223,213, filed on Aug. 4, 2000.

(51) Int. Cl.[7] ..... G08G 1/01

(52) U.S. Cl. ..... 340/933; 340/905; 340/917; 701/301

(58) Field of Search ..... 340/933, 905, 340/907, 917, 935, 936, 937, 938, 918; 701/300, 301

(56) References Cited

U.S. PATENT DOCUMENTS

| | | | | | |
|---|---|---|---|---|---|
| 3,983,531 | A | * | 9/1976 | Corrigan | 340/936 |
| 4,320,380 | A | * | 3/1982 | Berard et al. | 340/935 |
| 4,603,408 | A | | 7/1986 | Singhal et al. | 367/92 |
| 4,823,908 | A | | 4/1989 | Tanaka et al. | 181/175 |
| 5,162,794 | A | | 11/1992 | Seith | 340/903 |
| 5,231,393 | A | * | 7/1993 | Strickland | 340/936 |
| 5,381,155 | A | * | 1/1995 | Gerber | 342/104 |
| 5,617,086 | A | * | 4/1997 | Klashinsky et al. | 340/907 |
| 5,652,705 | A | | 7/1997 | Spiess | 364/436 |
| 5,673,039 | A | * | 9/1997 | Pietzsch et al. | 340/905 |
| 5,729,214 | A | * | 3/1998 | Moore | 340/905 |
| 5,819,198 | A | * | 10/1998 | Peretz | 701/117 |
| 6,084,533 | A | * | 7/2000 | Morgan et al. | 340/935 |
| 6,198,410 | B1 | * | 3/2001 | White et al. | 340/907 |
| 6,204,778 | B1 | * | 3/2001 | Bergan et al. | 340/936 |
| 6,213,401 | B1 | * | 4/2001 | Brown | 235/486 |
| 2001/0007591 | A1 | | 7/2001 | Pompei | 381/111 |

OTHER PUBLICATIONS

Smith, D., "Effective Collision Avoidance Systems for Light Vehicles, A Progress Report", Proc. ITS 2000, Intelligent Transportation Society of America, May 2000.

Pompei, F. Joseph, "The Use of Airborne Ultrasonics for Generating Audible Sound Beams," Presented at the 105th Audio Engineering Society Convention, Sep. 26–29, 1998.

* cited by examiner

*Primary Examiner*—Toan Pham

(74) *Attorney, Agent, or Firm*—Perkins, Smith & Cohen, LLP; Peter L. Borghetti; Jacob N. Erlich

(57) ABSTRACT

An audible warning system which reduces the number of land vehicle traffic accidents where there are already traffic control devices installed such as at stop signs, intersection control lights and on vehicles in conjunction with side lights, tail lights and brake lights. The accident reduction results from the monitoring of approaching traffic with a radar-type range sensing system. Sound generators, based on parametric-array technology, permit the focusing of sound into waves of a few degrees width and aiming them at a particular vehicle or pedestrian located at a particular range from the sound projector.

59 Claims, 18 Drawing Sheets

AUDIBLE COMMUNICATION SYSTEM

CROSS REFERENCE TO RELATED APPLICATIONS

This application claims priority of Provisional Application No. 60/223,213, entitled "Audible Warning System" filed on Aug. 4, 2000, and which is incorporated herein by reference.

BACKGROUND OF THE INVENTION

The present invention relates generally to communicating audibly with unequipped listeners, and, more particularly, to communicating audibly inside a compartment located at a distance from an audible source by modulating ultrasonic carrier waves with audible communication.

In recent years in the U.S., there are typically 16,000 fatal multiple-vehicle collisions See Eberhard, C. D. et al; Automotive Engineering March 1997, pp. 86–90; Miller, T.; Accident Analysis and Prevention Vol. 23 No. 3 ppl. 343–352 1997 and The U.S. Statistical Abstracts. The following five categories of multiple-vehicle collisions had direct annual monetary costs of:

| | |
|---|---|
| Cross-Path Collisions | $14.5 billion |
| Rear-End Collisions | $13.9 billion |
| Opposite Direction | $9.5 billion |
| Sideswipe | $2.8 billion |
| Backing | $0.8 billion |

Approximately 70% of the cross-path collisions took place where signs and signal were installed. The Federal Highway Administration recognized the problem in 1999 when they issued new standards mandating enhanced sign and signal visibility. Frustrated municipalities are changing their laws and investing in automatic cameras which photograph and then ticket drivers who "blow through" red lights.

In spite of arrays of flashing lights, rumble strips and other devices, turnpike toll booths need to be surrounded with concrete fortifications and are regularly the site of deadly rear-end collisions. Turnpikes are also the sites of deadly collisions with vehicles that have entered traveling in the wrong direction.

The U.S. Statistical Abstracts reports that there are 700 deaths and 30,000 injuries in highway construction zones. Drivers often fail to respond to numerous vehicle-mounted and roadside warning devices and crash into highway work crews at full speed. This is such a problem that many jurisdictions require highway work crews and their vehicles to be followed with crash-barrier trucks designed to absorb the impact of a crash from behind to save highway workers lives.

The reduced driving ability of the rapidly aging U.S. population is expected to make all this worse. In anticipation of the aging problem, the Federal Highway Administration (FHWA) this year issued guidelines for signs, signals and highway layout to deal with the older driver problem. Particular attention is being paid to standards for the how much light signs reflect when illuminated at night—the "retroreflectivity" of the signs.

In attempting to solve these problems, there is the danger of visual and audial pollution. This can be witnessed at an accident site where the wreckers, ambulances, fire and law enforcement vehicles are all outfitted with strobe lights. This can have a stupefying effect on passing drivers. Some jurisdictions have had to reduce the intensity of their LED traffic lights due to complaints from the public. Installing intense lighting and attention-getting coloration on every vehicle as well as on every sign and signal is unlikely to be accepted by the public. Sound emitted from rumble strips in roadways and well as audible blind-pedestrian crossing aids have been opposed by the public living nearby and their use has had to be curtailed or eliminated.

So there is the seemingly paradoxical need for a more intense means of warning, if not, a means of jarring, dangerously approaching drivers, while avoiding disturbing the majority of drivers who are approaching safely.

Research into vehicle-borne collision avoidance devices Smith, D.; Effective Collision Avoidance Systems for Light Vehicles, A Progress Report; Proc. ITS 2000, Intelligent Transportation Society of America, Boston May 2000, reports that automobile drivers react better to audible notifications than to visual ones. The literature on television advertising points to the superiority of sound over images. Trout, J.; The New Positioning; McGraw Hill NY, 1996; reports research showing the mind is able to understand a spoken work in 140 ms while 180 ms is required to understand a written word. The understanding of the written word fades in one second while the understanding of a spoken word lasts for 4 or 5 seconds. U.S. Army research, reported on by Trout, has shown that the intonation of speech can significantly affect the rate of information absorption.

Sound is used in traffic warning systems. For example, every vehicle is outfitted with a horn. Railroad crossing gates and toll-taking machines sound bells under certain conditions. Pedestrian crossings lights outfitted for blind pedestrians transmit sound to aid the blind pedestrian. Emergency vehicles are equipped with sirens and other sound emitting devices. Construction machines emit sounds when they are backing up. The effectiveness of these devices is limited by their inability to aim sound in a particular direction and their inability to focus it on a particular vehicle or pedestrian. This limitation is simply due to the need for a sound-projecting device, such as a horn, to be gigantic to focus its output into a narrow wave. An aperture with dimensions on the order of 50 wavelengths is needed to form a wave of a few degrees width. Since speech has frequency components as low as 300 Hz which implies sound with a 1-meter wavelength. To form 3° wide waves of 1-meter wavelength sound would require a horn with dimensions on the order of 50 meters!

Tanaka et al (U.S. Pat. No. 4,823,908) discloses directional speakers able to focus sound in a particular region of a large hall. These solve the directivity problem by using ultrasound whose wavelength in air is on the order of 5 to 10 millimeters. This implies a sound emitting aperture, to achieve 3° wide waves, of 8-to 16-centimeter dimensions. The audible message modulates the amplitude of the ultrasonic carrier wave in a way that is similar to what takes place with AM radio. Nonlinear properties of air in the presence of intense sound waves are used by Tanaka et al to demodulate the ultrasonic carrier and produce audible sound from the highly focused ultrasonic carrier waves. The sound emitter disclosed by Tanaka et al uses a complex baffling system which is unsuitable for mounting on a traffic control sign or signal or on a vehicle. Unfortunately, their technique yielded unacceptably high levels of harmonic distortion.

It is therefore an object of this invention to significantly improve the effectiveness of traffic control systems by giving them a means of communicating audible messages into the sealed passenger compartment of conventional approaching vehicles.

It is further an object of this invention to exploit the superiority of sound communication over visual communication.

It is further an object of this invention that the devices should be electrically compatible with and mount easily onto existing traffic control systems such as signs, signals and vehicles.

It is further an object of this invention to enable vehicles to communicate with other vehicles such as those that are approaching dangerously for the conditions at hand.

It is further an object of this invention for vehicles to communicate with pedestrians or the drivers of vehicles potentially in the path of movement of the vehicle issuing the warnings.

It is further the object of this invention to automatically control the acoustic projector's direction of transmission and the range of the focal point of the sound wave by coupling it with radar devices which measure direction, range and other characteristics of targets by analyzing skin reflections received from the targets.

It is a further object of this invention to communicate audible messages into a localized region without disturbing the whole area around the localized region.

It is a further object of this invention to delineate channels of movement such that unequipped people either walking or riding on a vehicle who depart from a channel will receive audible communication directing them back into the channel.

It is further the object of this invention to monitor ambient atmospheric conditions and modify the parameters of sound transmission as condition change.

It is a further object of this invention to provide a means to focus sound onto the upper window of a building from a distance and communicate with people located inside.

SUMMARY OF THE INVENTION

The objects set forth above as well as further and other objects and advantages of the present invention are achieved by the embodiments of the invention described hereinbelow.

This invention improves the ability of traffic control systems such as signs, signals, and officials, near roadways as well as vehicle-mounted lights and other visibility enhancers to communicate their messages to approaching vehicles. If an approaching vehicle is unresponsive, the intensity and urgency of the warning can be increased to the point of jarring the unresponsive driver or pedestrian. This is accomplished with a range sensing device, such as a radar system, which monitors approaching traffic and provides feedback on how well an approaching vehicle is reacting to the communications that the signs and signaling devices are presenting.

Vehicle drivers, pedestrians and others often fail to react to visual communications because they are inattentive, distracted, intoxicated or physically impaired. Research has shown that audible communication is superior to visual communication. This invention will give an audible voice primarily to traffic control devices as well as the ability to focus that voice on a particular vehicle or pedestrian as opposed to everyone in the general area.

The following examples of use of this invention are for purposes of examples and not as a limitation on the invention's use. For example, the invention can be used for example with: "STOP " and "Wrong Way" signs; traffic lights at intersection curve ahead signs; speed limit signs; flagman or police officers guarding highway work zones; tail, brake and side lights on the rear of land vehicles; pedestrian crossing signals; a directed warning siren or vehicle backing indicator; and vehicles trailing a vehicle traveling in snow or fog.

In addition, the present invention could be used with for example: navigational marks at sea; navigation lights on watercraft, and watercraft traveling in fog or other low visibility situations.

The invention can also be used by fire and other public safety personnel to communicate with people behind the closed windows of a building.

The invention can also be used in aviation applications for ground and air traffic control. Aircraft taxiing to and from the terminal, runway, and maintenance hanger can be contacted by the control tower or specially equipped aircraft with greater speed and accuracy than the current reliance on radio transmission and reception. In-flight near misses will be eliminated with aircraft equipped with the present invention. Audio communication in the cockpit will no longer rely on the radio being turned on or being tuned to the correct frequency.

In general, the invention utilizes ultrasonic carrier waves that are demodulated, after a period of time, when they encounter and then compress a window whose stress-to-strain relationship is nonlinear, in order to exploit the propagation of the audible sounds, resulting from the demodulation process inside the window glass, into the air-filled compartment the window encloses. The intersection of a large number of modulated ultrasonic carriers at one point in open air can drive the air into saturation which will also demodulate the carrier waves. This permits the establishment of boundaries for channels of movement for pedestrians or vehicles that will direct unequipped errant travelers back into the channel of movement.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

The preferred embodiment of the present invention is a traffic control system that continuously monitors and communicates with, when necessary, approaching traffic. The time history of the range of an approaching vehicle is analyzed by a conventional digital computer coupled to the range-sensing device. For the purposes of the present invention, a vehicle is any means to transport people or cargo, including land vehicles, watercraft, and aircraft. A decision is made whether or not the approaching vehicle will be able to stop in the remaining distance. A message is transmitted to warn the dangerously approaching vehicle to the point of jarring a driver without special equipment installed in the vehicle.

Figure 1:
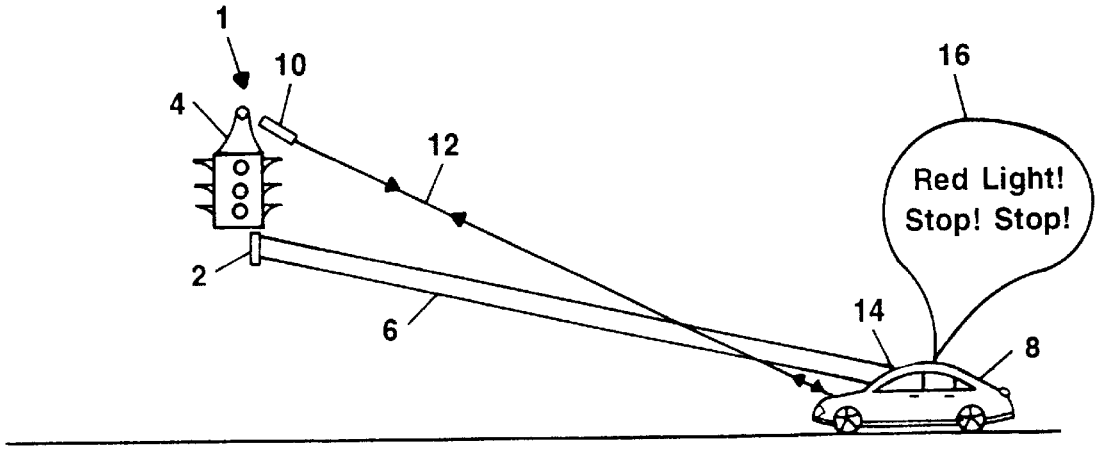
FIG. 1 pictorially represents an intersection traffic control light equipped with a range sensor and the modulated-ultrasound projector of this invention with the sound projector communicating to the driver in the interior of the approaching vehicle.

The preferred embodiment of the above invention illustrated in the accompanying drawings, as illustrated in FIG. 1 is a pictorial view of the audible communication system constructed in accordance with the invention, same being generally indicated by numerical designation 1. The system 1 generally includes an ultrasonic sound projection system 2 in wired or wireless communication with a range sensing system 10.

Figure 2:
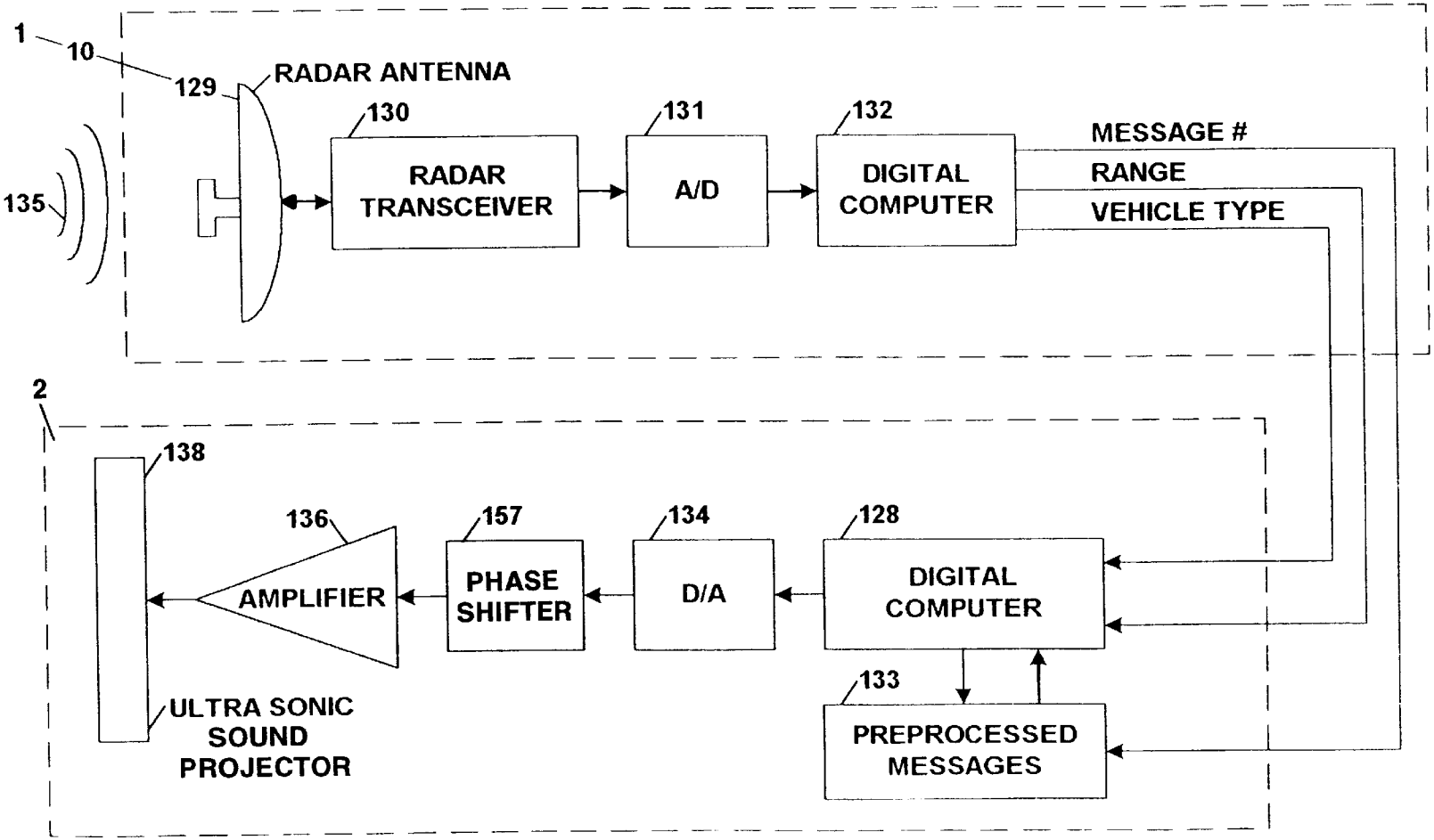
FIG. 2 represents a block diagram that includes a range-sensing radar whose returns are analyzed by a digital computer and the results of the analysis are passed to a second digital computer, which controls the parameters of the ultrasound projector in accordance with this invention.

A schematic of the audible communication system 1 is illustrated in FIG. 2. As shown in FIG. 2, the ultrasonic sound projection system 2 preferably includes a digital computer 128 with storage capacity 133 for preprocessed messages, a digital-to-analog converter 134, an amplifier 136, and an ultrasonic sound projector 138. The range sensing system 10 preferably includes a radar transceiver 130 with a radar antenna 129, an analog-to-digital converter 131, and a digital computer 132. The range sensing system 10 signals the ultrasonic sound projection system 2 with information, such as vehicle range, vehicle type, and a message, when a subject vehicle is approaching a predetermined point at a dangerous speed. The vehicle type information is used to cross reference characteristics, such as model, make, year, windshield angle, windshield thickness, and windshield material, for the transmission of the appropriate warning signal that will demodulate to an audible sound once the warning signal passes through the windshield. All vehicle window information will be stored in either or both of the digital computers 128, 132, in cases where the ultrasonic sound project system 2 is positioned to transmit a signal directed towards the side of the vehicle. The ultrasonic sound projection system 2 transmits a warning signal to the subject vehicle(s).

Provided below is a detailed analysis of the concepts underlying the various embodiments of this invention. More specifically, the production of sound from nonlinearities of air.

Air is excitable by an intense ultrasonic wave, which has been modulated with audible communications. The ultrasonic wave modulated by the audible communication, e (t), is given by:

$$p_1(t)=P_1e(t)\sin(\omega_c t) \qquad \text{Equation 1}$$

and the secondary wave generated by the nonlinearities of the air demodulating the ultrasound wave given by:

$$p_2(t)=[(\beta P_1^2A)/(16\pi\rho_o\alpha C_o^4z)]\theta^2/\theta t^2e^2(t) \qquad \text{Equation 2}$$

Where:

$\theta^2/\theta t^2$ is the partial second derivative with respect to time $P_1$ is amplitude of the launched ultrasonic carrier wave $p_1(t)$ is the primary, ultrasonic carrier, wave pressure as a function of time, t.

e(t) is the modulation envelope of the ultrasonic carrier wave.

$\omega_c$ is the angular frequency of the carrier $p_2$ (t) is the pressure of the secondary, audible, wave demodulated by the nonlinearities $\beta$ is the coefficient of nonlinarity:

$$\beta=(\gamma+1)/2$$

where $\gamma$ is the ratio of specific heat $\rho_o$ is the ambient density of the medium $c_o$ is the small signal wave propagation speed A is the wave cross section area z is the axial distance is the absorption coefficient of the medium at $\omega_c$ Equation 1 sets forth a square-law nonlinearity due to the saturation of air in which the intense ultrasonic waves are traveling.

The amplitude of the secondary (demodulated) wave is proportional to the second derivative of the square of the modulation envelope. It is preferred that the pressure intensity be large with respect to the physical constants of the air as set forth in Equation 2.

The generation of audible sound is achievable by reflecting ultrasonic waves off of a solid surface in the direction of the source of the modulated ultrasonic waves. The nonlinear stress/strain relationship of the solid surface is responsible for demodulation of the audible communication and the generation of the audible sound. This takes place in much the same way as the nonlinearities of air generating sound in open air as described by Equation 2.

The present invention expands this known technique to the generation of the demodulated sound on the other side of a window or other panels enclosing a compartment so that a person can be hear the message on the opposing side of the window or compartment relative to the incoming wave.

Figure 3:
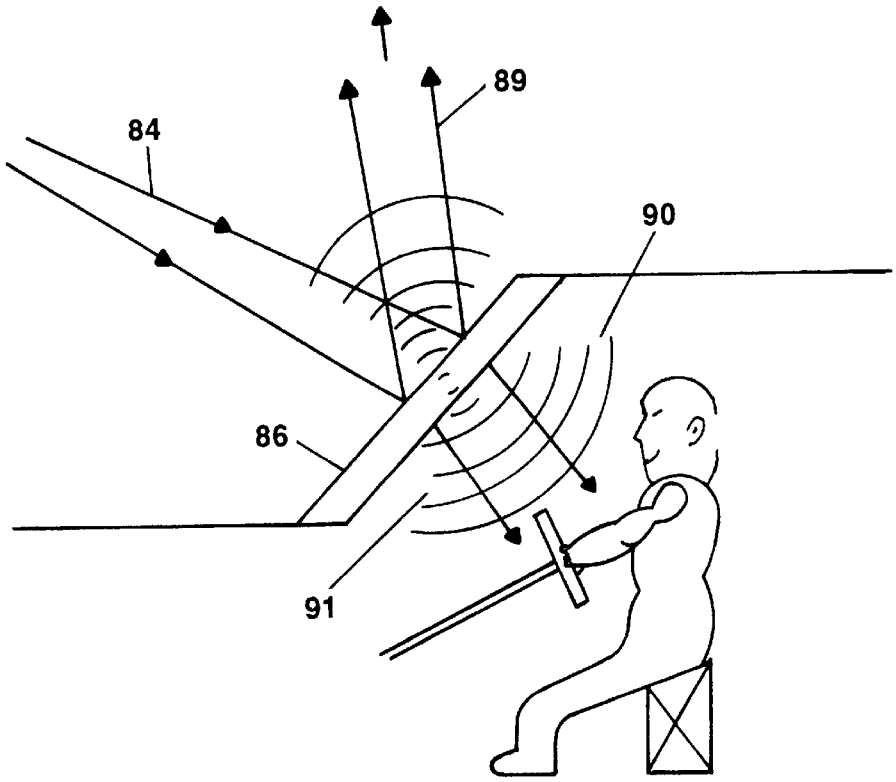
FIG. 3 pictorially represents a modulated-ultrasound focused on a vehicle's windshield in accordance with this invention.

FIG. 3 illustrates the arrival of the millimeter-wavelength ultrasonic wave 84 focused on the windshield 86. The approximately 6 to 1 ratio of the velocity of sound in windshield 86 to the velocity in air causes the ultrasonic wave 84 to be reflected 89. If the angle of incidence is within a few degrees of normal to the surface of the windshield 86, the ultrasonic wave 84 is also refracted, refracted ultrasonic wave 91. With or without refraction the ultrasonic wave 84 striking the surface of the windshield 86 undergoes a non-linear interaction with the windshield 86 much as intense sound undergoes in air driven into saturation as described in Equation 2. The ultrasonic wave 84 interacts with the non-linear stress-to-strain relationship of the windshield 86. This nonlinear interaction with the windshield 86 demodulates the ultrasonic wave 84 resulting in the reproduction of 0.1-meter wavelength audible sound 90 near the surface, but on the opposing side, of the windshield 86. Further demodulation may take place if the ultrasound wave 84 is refracted through the windshield 86. In many cases, the windshield 86 will be made up of a laminate of glass and plastic.

Figure 4:
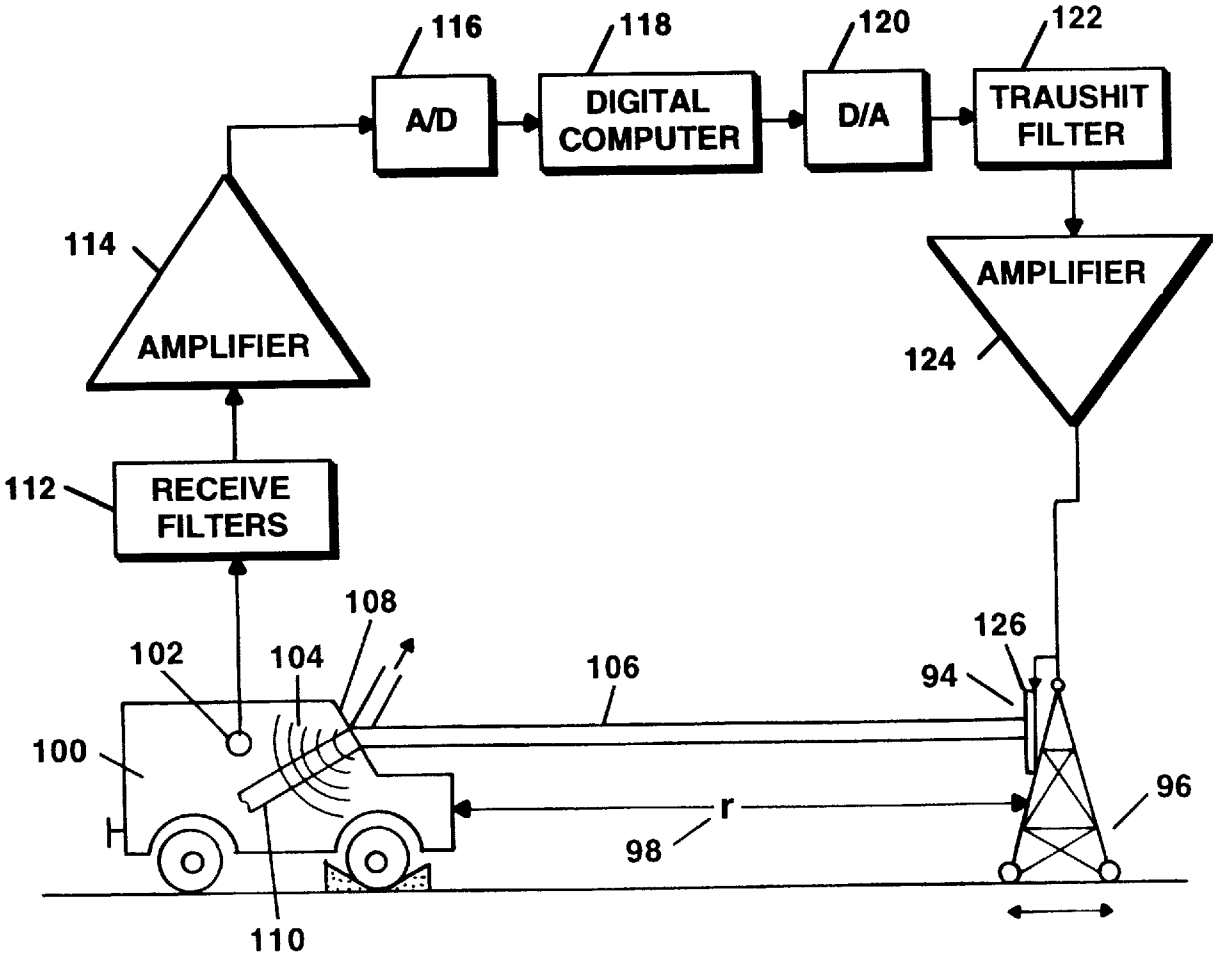
FIG. 4 schematically and pictorially represents a test range on which a vehicle is targeted by a modulated ultrasound wave from a projector.

A further feature of the present invention relies upon preprocessing the transmitted sounds for optimum generation of audible sound by demodulating the ultrasonic wave as it passes through the windshield. In the present invention, the calibration process described in FIG. 4 is used for recording the audible sound 104 generated in the passenger compartment 110 by the ultrasonic wave 106 interacting with the windshield 108 of the vehicle 100. These recordings are used to develop messages that have been preprocessed for optimal generation of intelligible audible sounds 104 inside the vehicle 100 utilizing the techniques of FIGS. 5 and 6 that are discussed below. These preprocessed messages are stored in the ultrasonic sound projection system 2 for later use.

FIG. 4 represents a test range used to demonstrate the concepts of the present invention and to preprocess messages for use with the system 1. In FIG. 4, an ultrasound wave projector 94 is mounted on a suitable movable mount 96 so that the range 98, r, can be varied during the data gathering process. (In some cases, it is necessary to vary the height of the projector 94 during the data gathering process.) A cross section of a land vehicle 100 is shown. A microphone 102 is mounted where a typical driver's head would be. The microphone 102 records the audible sound 104 that is generated by the demodulation of the ultrasonic wave 106 as it interacts with the windshield 108 and enters the passenger compartment 110 of the vehicle 100. The audible sound 104 recorded by the microphone 102 is filtered by a receive filter 112 and then amplified by amplifier 114. The amplifier 114 and filter 112 remove vestiges of the ultrasonic wave 106 and image frequency generated by the demodulation process in the windshield 108. The audio signal is also band limited by the filter 112 to prevent distortions that can result from aliasing of noise and other signals above the Nyquist frequency as they are digitized by the analog-to-digital converter (A/D) 116. The digital samples of the audio waveform are passed to the digital computer 118 for processing and storage. The digital computer 118 is also used to generate a stream of digital samples of messages modulating an ultrasonic wave 106, which are converted to analog signals by the digital-to-analog converter (D/A) 120. The output of the D/A 120 are filtered by the transmit filter 122. The transmit filter 122 smoothes the so called boxcar effects of the digital-to-analog conversion process and removes other undesirable higher frequency components from the signal before they are amplified by the power amplifier 124. The amplified signal drives an array of electrostatic or piezoelectric speakers 126 used to project the ultrasonic wave 106 onto the windshield 108 of the test vehicle 100.

Figure 5:
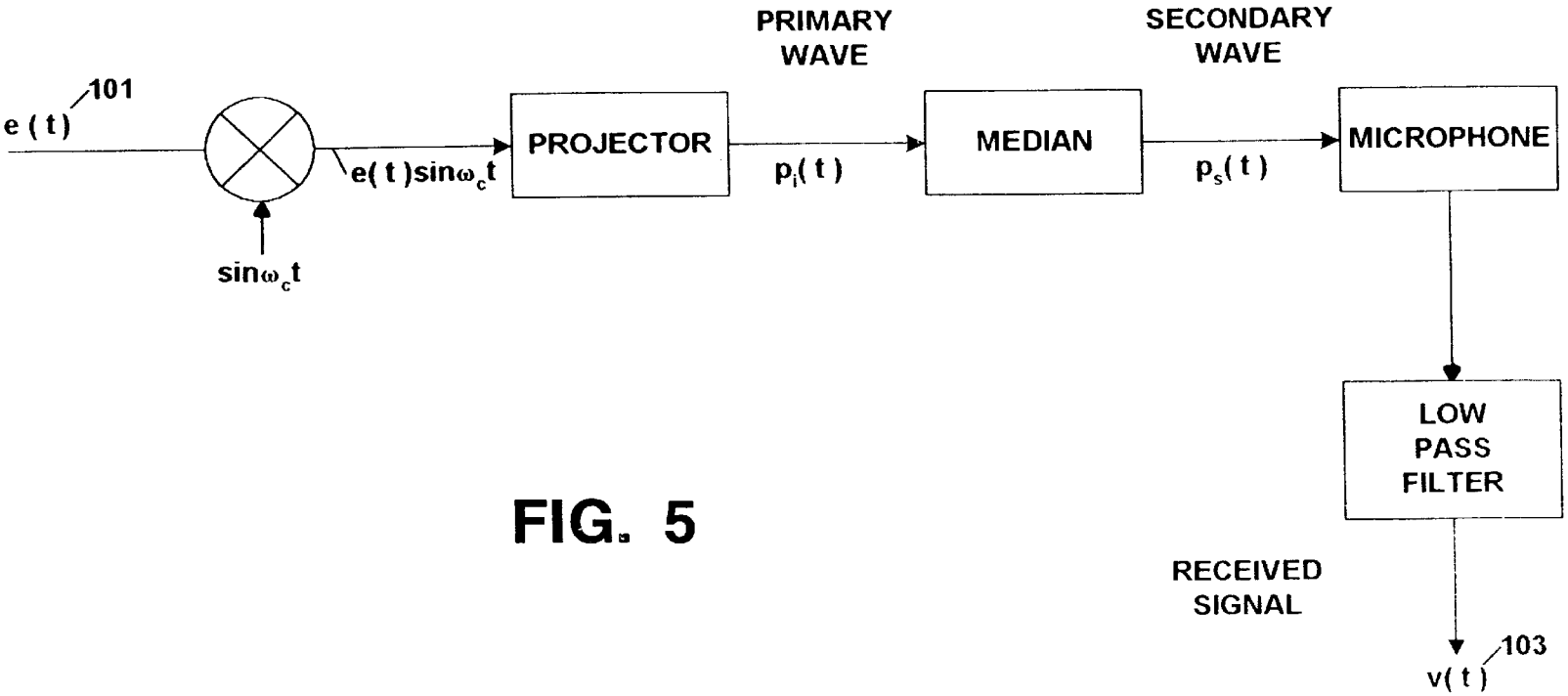
FIG. 5 is a block diagram representing the transmission path of sound from an ultrasound projector to the received signal at the filtered output of a microphone in accordance with this invention.

A block diagram of the flow of signals through the calibration of FIG. 4 is presented in FIG. 5. The objective is to compute a source waveform, e (t), needed to generate a prescribed voice waveform, v (t). For example, the desired waveform, $v_d$ (t), might be the waveform of the audible utterance: "stop." In FIG. 4, one might desire an utterance of the word: stop 104 to be received inside of the passenger compartment 110 of the vehicle 100. The problem is to compute which digital waveform needs to be transferred to the D/A converter 120 by the digital computer 118 for "STOP" to be audible inside the vehicle.

The transmission of the signal, e (t), through the system to generate v (t) is a nonlinear process. The ultrasonic wave compresses and decompresses the solid as it propagates through the surface of the solid. The stress-to-strain relationship of the solid will in general be nonlinear. A technique for compensating for the distortions introduced by the nonlinear interactions is disclosed by Singhal et al in U.S. Pat. No. 4,603,408, incorporated herein by reference. The synthesis of the transmitted waveform works with linear prefiltering of the waveform.

Figure 6:
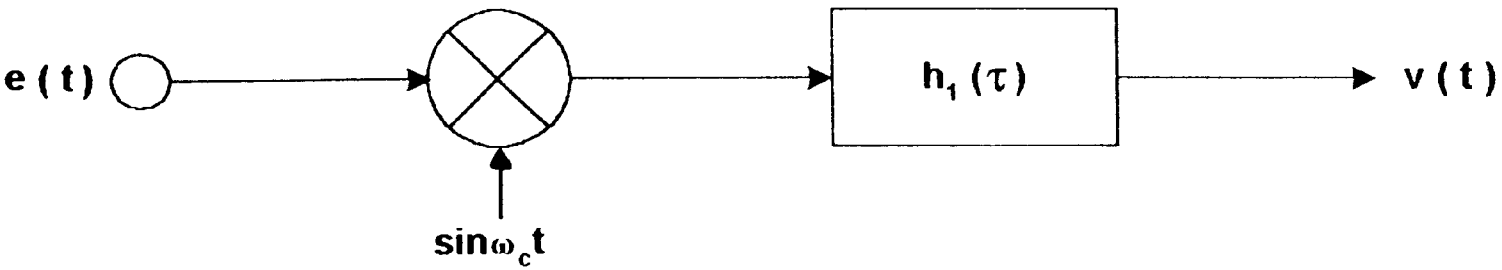
FIG. 6 sets forth a computational procedure for preprocessing a waveform for transmission over an ultrasonic wave in accordance with this invention.

A procedure for the linear prefiltering is given in FIG. 6. One begins with the desired audio waveform: $V_d$(t). Then to begin the preprocessing procedure the starting input waveform, e(t) is computed:

$$e(t)=[\int\int V_d(t)dtdt]^{1/2} \qquad \text{Equation 3}$$

The resulting input waveform, $e_o$(t), is used to drive the sound projector 126 in the test range depicted in FIG. 4. The audible sound 104, $v_o$ (t), received by the microphone 102 is then used to compute an improved wave form, $e_1$(t). The received wave form, $v_o$(t), is transformed to the frequency domain using the Fast Fourier Transform (FFT) algorithm:

$$V_o(\omega)=FFT[v_o(t)] \quad \text{Equation 4}$$

Similarly the input wave form, $e_o(t)$, is transformed with the FFT.

$$E_o(\omega)=FFT[e_o(t)] \quad \text{Equation 5}$$

Then the complex transfer function, $H_o(\omega)$, is computed:

$$H_o(\omega)=V_o(\omega)/E_o(\omega) \quad \text{Equation 6}$$

The complex transfer function $H_o(\omega)$ is used to compute the frequency-domain representation of the improved waveform:

$$E_1(\omega)=V_o(\omega)/H_o(\omega) \quad \text{Equation 7}$$

The frequency domain version is then transformed to the time domain $e_1(t)$ with the Inverse FFT (IFFT):

$$e_1(t)=[IFFT*E_1(\omega)]^{1/2} \quad \text{Equation 8}$$

The square root is taken to obtain the improved transmitted wave from, $e_1(t)$. (The square root is needed because of the squaring that takes place from the nonlinearities as modeled by Equation 2.) The preprocessing procedure then continues by inputting $e_1(t)$ and measuring $v_1(t)$.

The received audio signal, $v_1(t)$, is then transformed to $V_1(\omega)$, the frequency domain equivalent:

$$V_1(\omega)=FFT[v_1(t)] \quad \text{Equation 9}$$

$V_1(\omega)$ and $E_1(\omega)$ then serve as the inputs to a recursive averaging operation:

$$H_1(\omega)=H_o(\omega)+(1/N)[\{V_1(\omega)/E_1(\omega)\}-H_o(\omega)] \quad \text{Equation 10}$$

The recursive averaging process of Equation 10 yields an improved transfer function $H_1(\omega)$. Note that in Equation 10, $H_o(\omega)$ is subtracted from $H_1(\omega)$. ($H_1(\omega)$ is computed from the ratio of $V_1(\omega)$ and $E_1(\omega)$ in Equation 10.) After a few iterations, the latest update to the transfer function will be very similar to the previous version and thus the recursive averaging procedure will cease to change the values. The procedure then uses the desired frequency-domain spectrum and the latest estimate of the transfer function to compute an improved frequency spectrum:

$$E_1(\omega)=V_o(\omega)/H_1(\omega) \quad \text{Equation 11}$$

Then the IFFT and square root operations are carried out:

$$e_2(t)=[IFFT*E_1(\omega)]^{1/2} \quad \text{Equation 12}$$

in the same way as in Equation 8. The procedure then continues by inputting $e_2(t)$ and measuring $v_2(t)$. This procedure can be iterated until convergence is reached.

For example, suppose the utterance "STOP!" was needed. The test range depicted in FIG. 4 would be setup and "STOP" will be processed with the procedure of FIG. 6 to obtain a version that will yield an intelligible "STOP" inside of the vehicle. It may be necessary to carry out the preprocessing of FIG. 6 for different ranges, type of vehicle, angle of incidence, atmospheric conditions, and amplitudes of signals due to the nonlinearity of the system. The preprocessed messages are stored in the digital computer 128 of the ultrasonic sound projection system 2. Examples of other preprocessed messages include reduce speed or change course.

Figure 7:
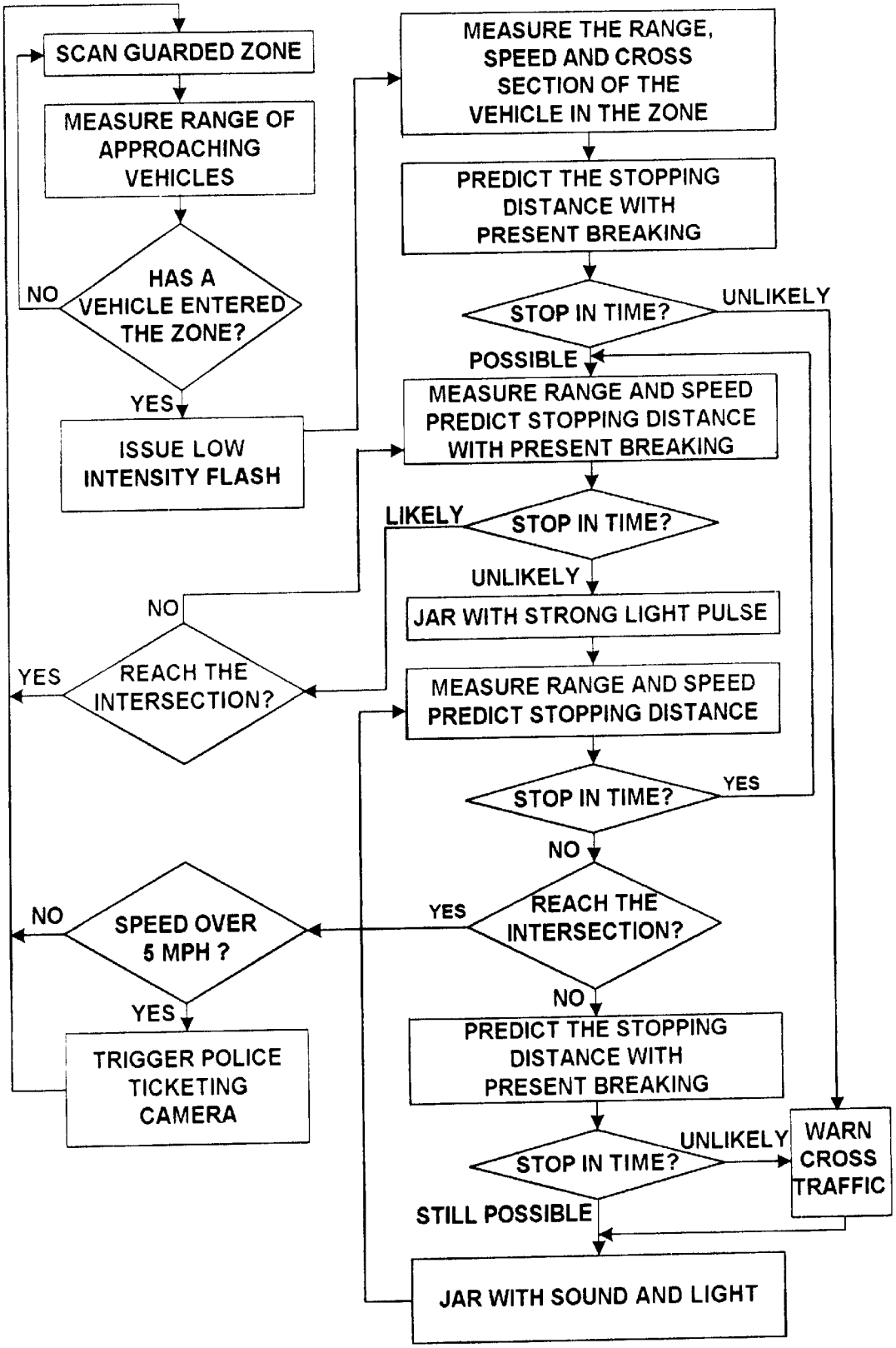
FIG. 7 is a flow chart of a digital computer program in accordance with this invention that would analyze the range information from the radar range sensor and issue warning in response to the situation at hand in accordance with this invention.

Returning now to FIG. 2, the block diagram illustrates an embodiment of the invention suitable for mounting on a sign or signal. A microwave radar transceiver 130 monitors the range of approaching vehicles by processing the radar returns 135 with the digital computer 132. Though the range sensing system 10 is preferably microwave, any conventional radar system, including radio, laser, and acoustic, is acceptable. An analysis of the time histories of the approaching vehicle's range as well as an measurement of the approaching vehicle's radar cross section are input to a computer program, as illustrated in FIG. 7, executable by the digital computer 132. The flow chart in FIG. 7 sets forth the mode of operation in words. The chart describes the control of the launching of available lights and sounds at unresponsive drivers. If the unsafe driver fails to respond to the lights or sounds, cross traffic is warned of the danger and police ticketing cameras can be triggered. The digital computer 132 then passes information such as: the number of the desired message, the range of the vehicle and the type of vehicle to the digital computer 128. Digital computer 128 then selects the requested message from its set of stored preprocessed digital waveforms that are appropriate for the range and type of vehicle and transfer them to the D/A converter 134. The analog signal output of the D/A converter 134 is then amplified by the power amplifier 136 and used to drive at least one sound projector 138. It should be noted that computers 128 and 132 could be incorporated into a single computer (not shown).

Figure 8:
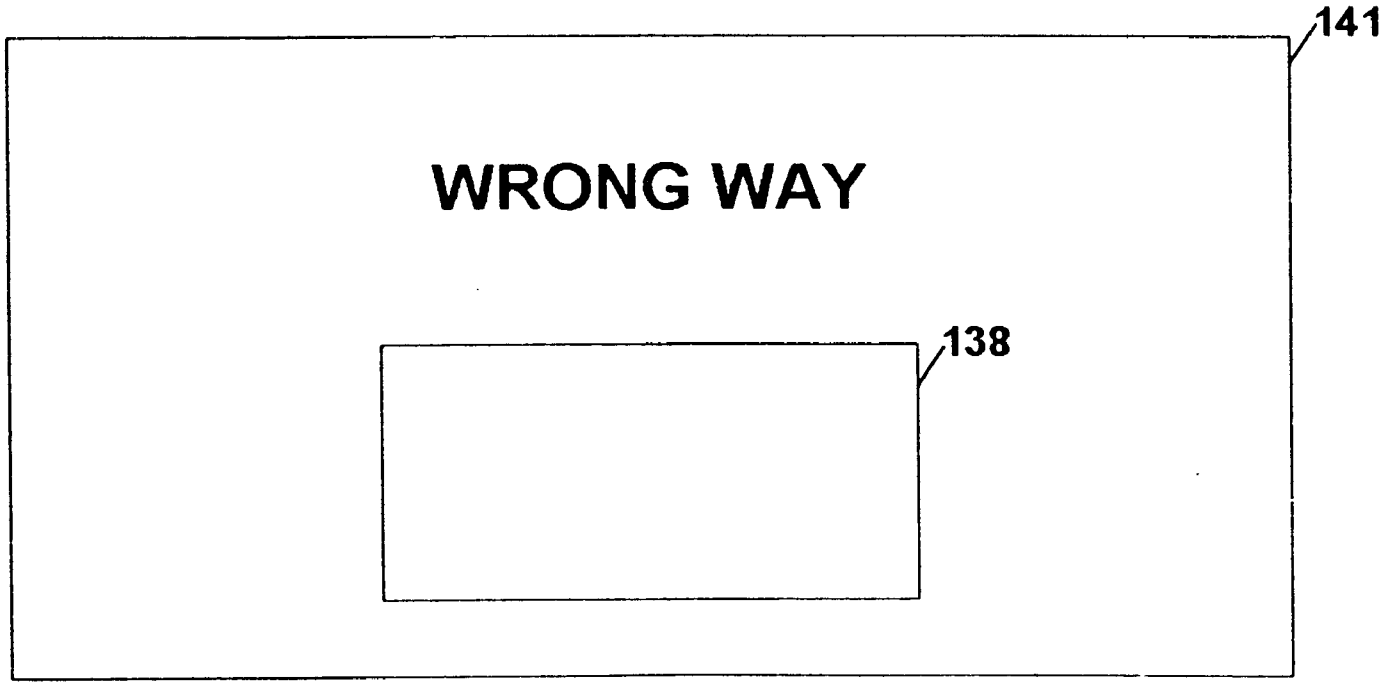
FIG. 8 pictorially represents a flat electrostatic speaker or sheet piezoelectric projector mounted on the face of a traffic control sign in accordance with this invention.
Figure 9:
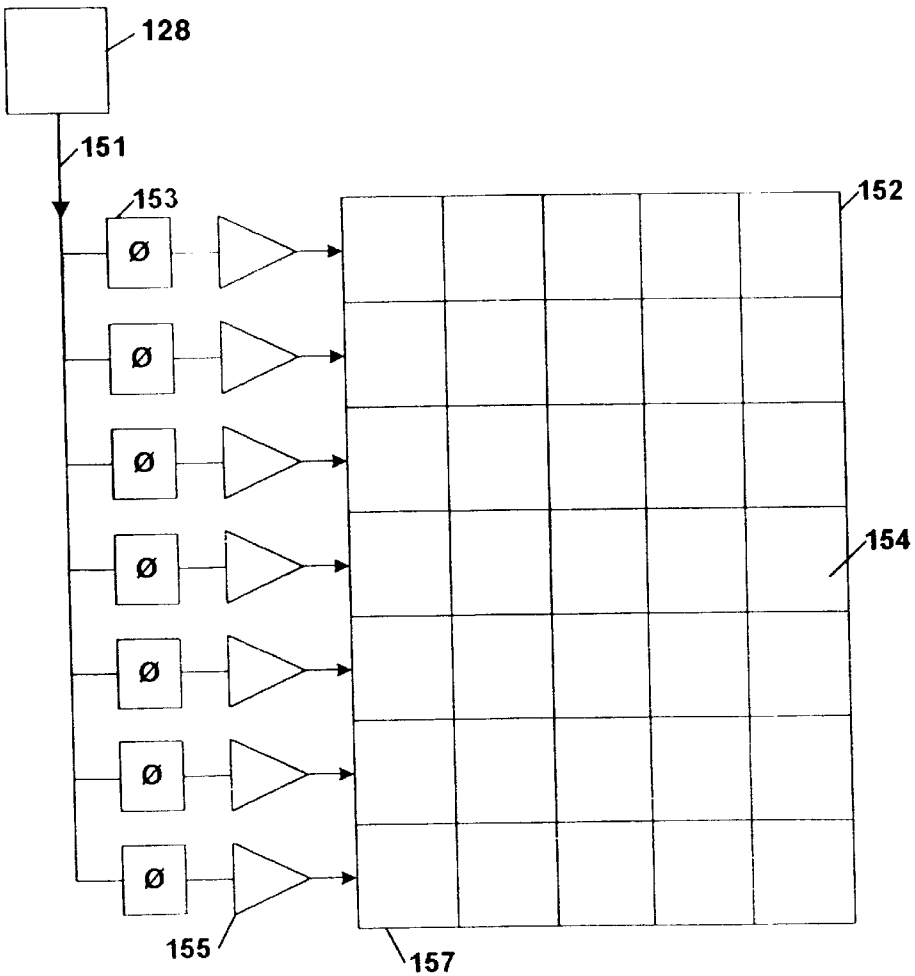
FIG. 9 schematically represents an array of electrostatic speakers or piezoelectric projectors in accordance with this invention.
Figure 10:
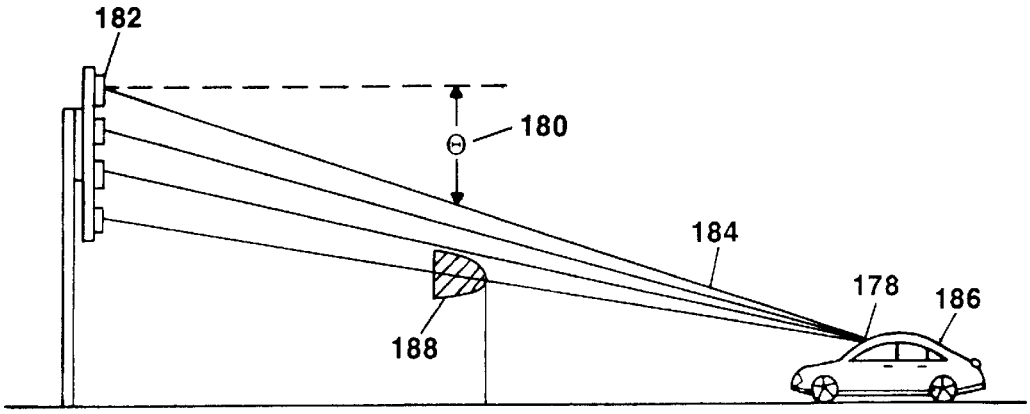
FIG. 10 is a pictorial representation of an array of steerable ultrasound projectors of this invention.

A sound projector 138 can be electrostatic or piezoelectric thin sheets mounted directly on the face of a sign 142, as illustrated in FIG. 8, or, as illustrated in FIG. 9, a 5×7 array of electrostatic or piezoelectric sheets. Each of the thirty-five individual sheets of the 5×7 array is a functioning speaker 154. The individual speakers 154 are used as a phased array 152. The resulting ultrasound waves (not shown) emitted from the individual speakers 154 are steered by controlling the phase between speakers with phase-shifter 153. FIG. 10 illustrates a multiple-wave sound projector 182 steering, by conventional means, its waves 184 through an angle θ 180 so the waves 184 converge on the windshield 178 of an approaching vehicle 186. Now returning to FIG. 9, the phase shifters 153 are driven by a control signal 151 generated by second digital computer 128. The output of the phase shifters 153 drives the speakers 154 using power amplifiers 155. The amount of phase shift introduced by the phase shifters 153 is under the control of the digital computer 128 in FIG. 2. The digital computer 128 receives automatically the subject vehicle coordinates from the range sensing system 10 via the computer 132, and calculates the phase shift for each of the individual speakers 154 to focus the wave upon the windshield of the moving vehicle. The preferred embodiment utilizes one amplifier and one phase shifter per speaker. In this case, there would be thirty-five phase shifters and amplifiers. The array of speakers can be implemented in several configurations not just the rectangular configuration illustrated in FIG. 9. Circularly-shaped arrays and polygon-shaped arrays are also effective for phased-arrays.

Figure 11:
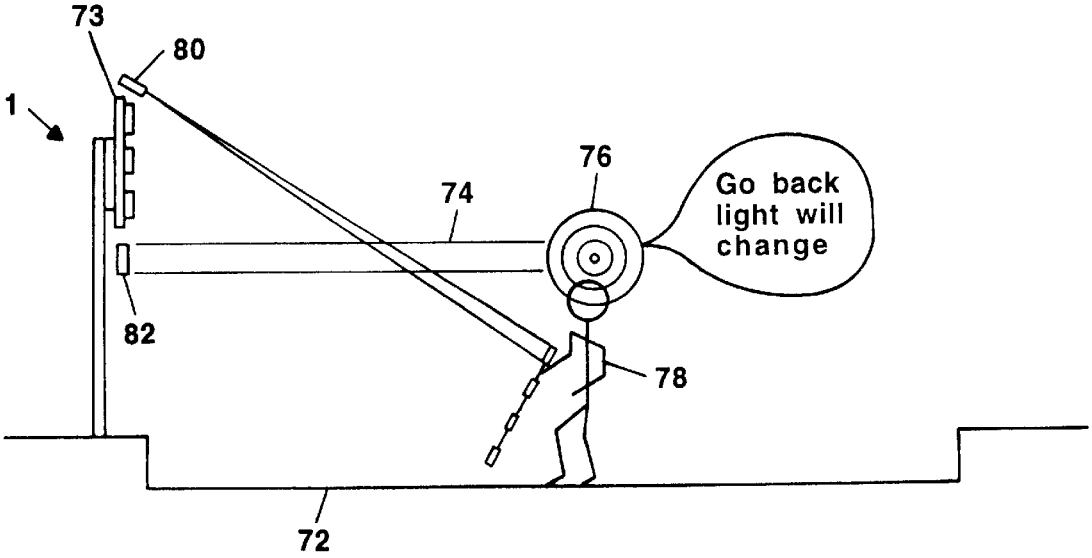
FIG. 11 is a pictorial representation of a radar equipped pedestrian crossing signal communicating with a blind pedestrian at a particular distance from the traffic signal by focusing the modulated ultrasound so that audible sound is generated over the pedestrians head in accordance with this invention.

The generation of audible sound in open air as opposed to projecting the sound into the interior of a vehicle can facilitate, as illustrated in FIG. 11, a blind pedestrian 78 crossing a roadway 72. The ultrasound source 82 is directing a warning to the pedestrian 78 whose location is determined by the radar sensor 80. The objective is to generate the audible message 76 only in the vicinity of the pedestrian 78. This can be accomplished with the embodiment of the present invention depicted in FIGS. 12, 13, 14, and 15.

Figure 12:
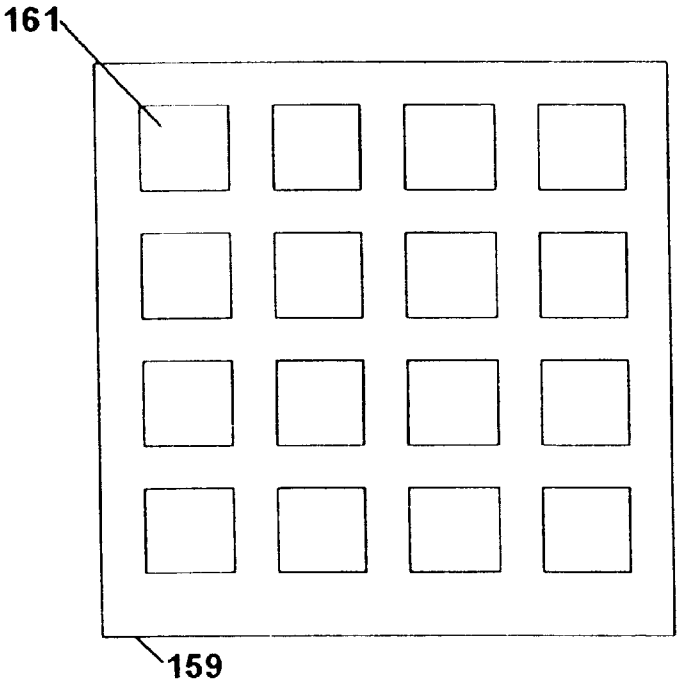
FIG. 12 is a pictorially representation of an ultrasonic sound system having a 4×4 array of speakers.
Figure 13:
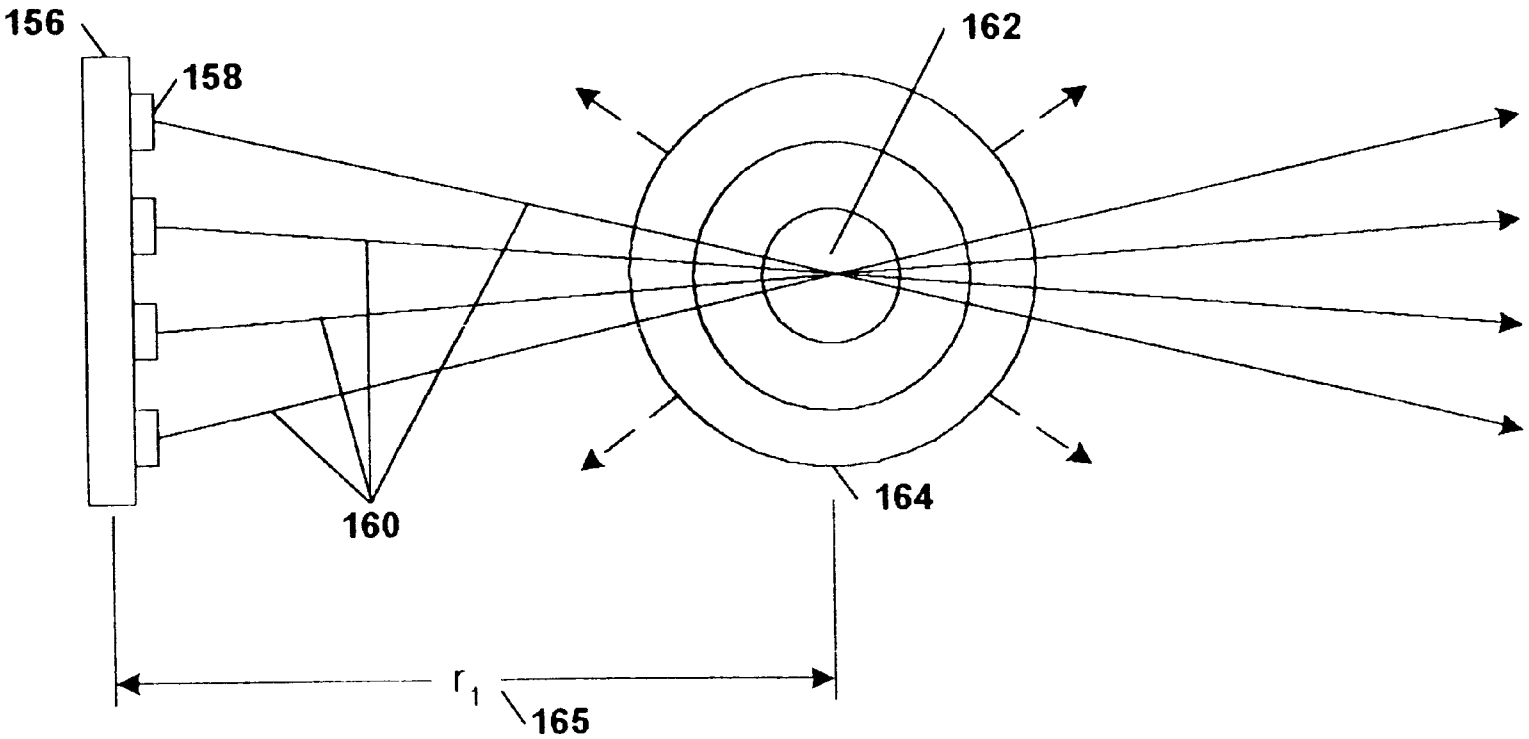
FIG. 13 is a pictorial schematic illustration of multiple ultrasound waves demodulated a range of $r_1$, where the multiple waves intersect.

As illustrated in FIG. 12, the ultrasound projector 159 is made up of a number of phased arrays 161. Each phased array is steerable and its wave can be moved in azimuth and elevation, as discussed above. As illustrated in FIG. 13, the projector 156 shows the individual waves 160 aimed so that they converge at point 162 which is located at a range of $r_1$ from the sound projector 156. The convergence of multiple waves 160 whose waveforms are in phase in one region increases the intensity of the pressure of the ultrasound in that region. The intense sound drives the air into its nonlinear mode of behavior as given by Equation 2. The nonlinear behavior demodulates the ultrasonic wave 160 and generates an audible secondary sound 164 emanating from the region located at a range of $r_1$.

Figure 14:
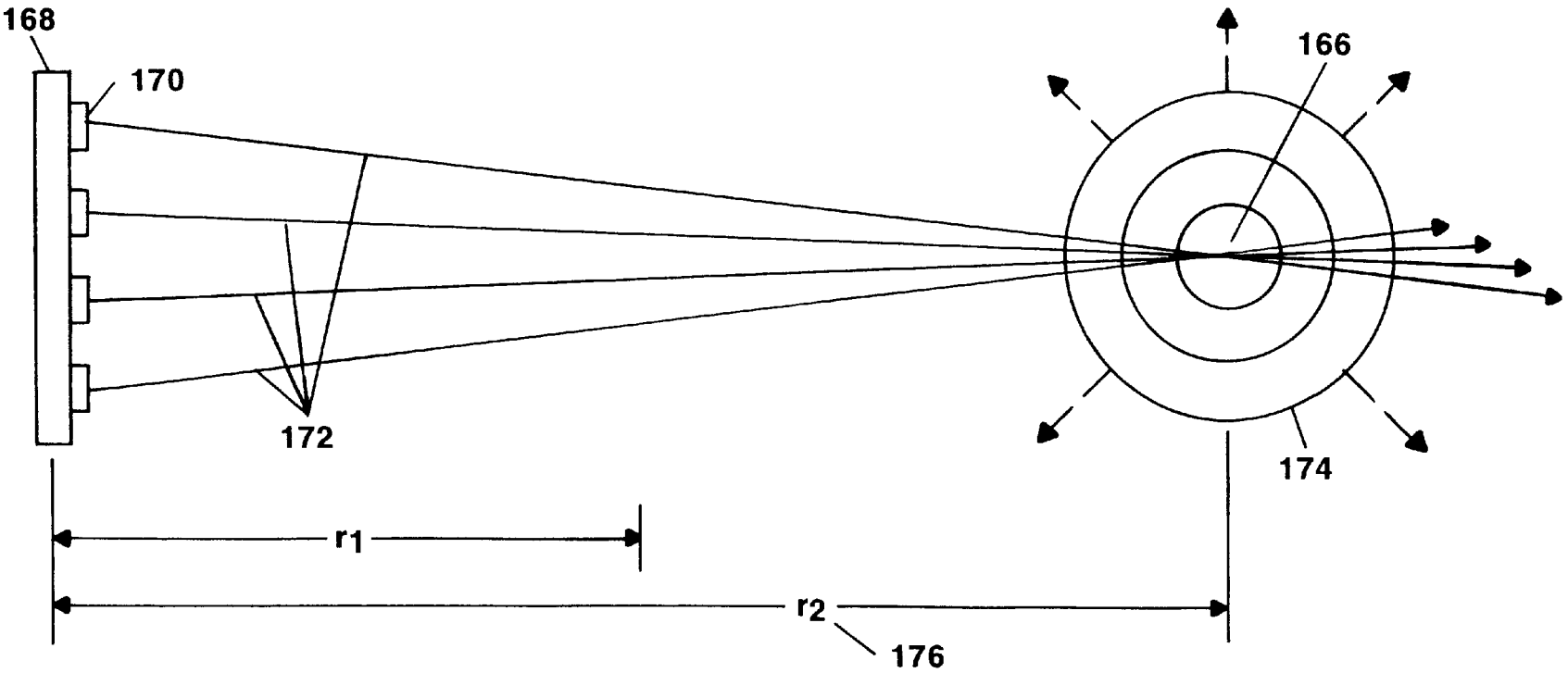
FIG. 14 schematically represents an ultrasound projector system steering its multiple waves so that ultrasound demodulation takes place at a range $r_2$.

In FIG. 14, a sound projector 168 makes use of its individual phased arrays 170 to aim its waves 172 so that they converge at point 166 located at a range 176 of $r_2$ from the sound projector 168. This technique of moving the region of wave convergence permits the secondary source of the audible sound to be moved back and forth from the sound projector to address pedestrians at different locations in the cross walk. The different regions could receive different messages. For example, the pedestrian is being asked to return to the curb from which she came. A pedestrian close to the sound projector might be told to quickly mount the curb, as traffic would soon restart.

Figure 15:
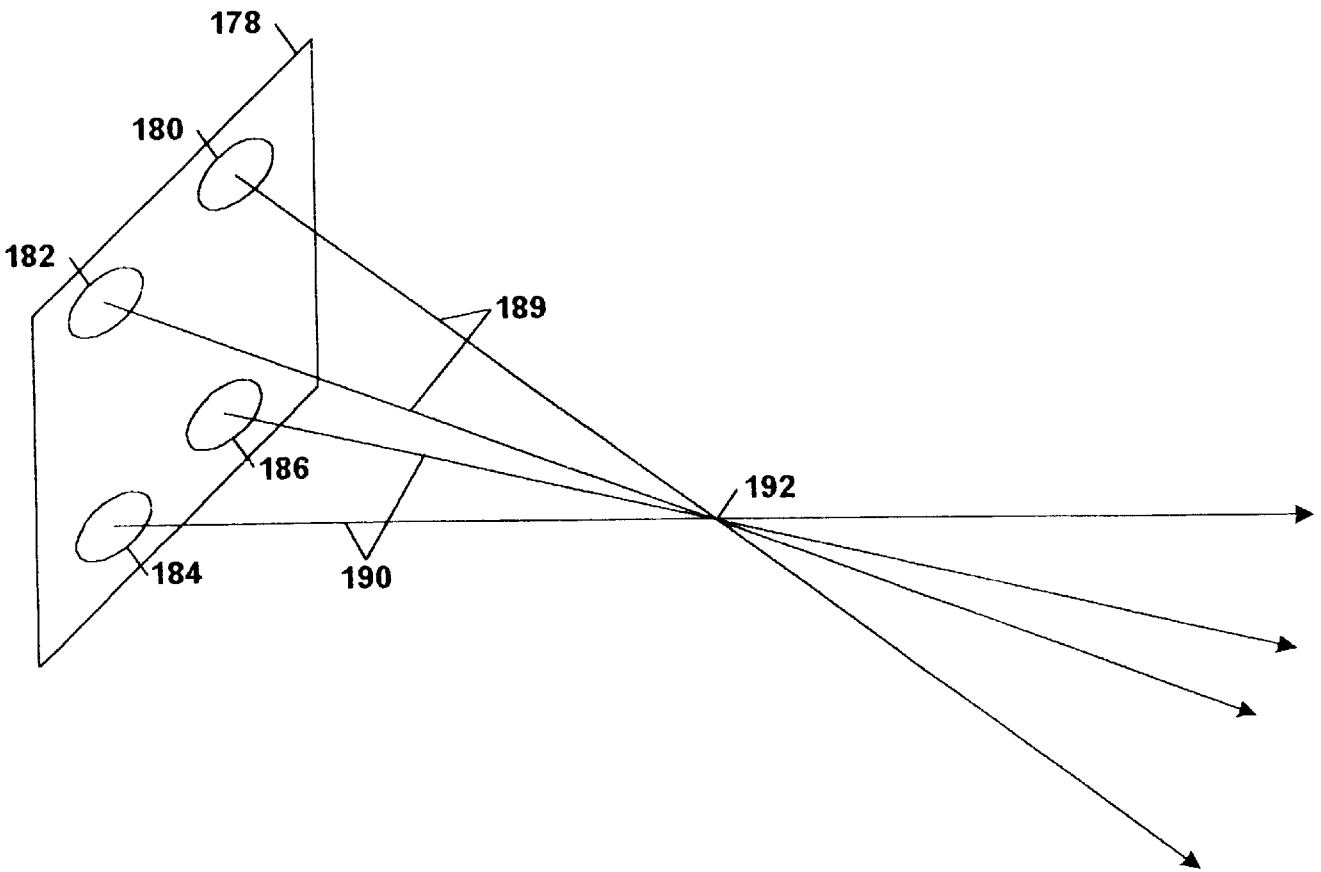
FIG. 15 is a schematic illustration of four ultrasound waves emitted by four phased arrays and crossing at one point located at some distance from the phased arrays in accordance with this invention.

FIG. 15 illustrates the convergence of multiple sound waves emanating from a projector 178 on which are mounted phased arrays 180,182,184 and 186. The waves 189 and 190 converge on point 192. The dimensions of the phased array can be quite small since the ultrasound will typically have wavelengths in the range of a few millimeters.

Now returning to FIG. 1, an ultrasound sound projector system 2 is installed on a traffic light signal 4. A narrow ultrasonic wave 6 is focused on an approaching vehicle 8. The traffic light 4 is also outfitted with a vehicle range sensing means 10 such as a radar sensor. The range of the approaching vehicle 8 is detected by the radar range sensor's wave 12. The range measurement is used to set the parameters of the ultrasonic sound projector system 2 and steer its ultrasound wave 6. An example of a decision process for a system with visual and audible warning means as well as a police-ticketing camera is diagramed in FIG. 7. The ultrasonic wave 6 is demodulated by the nonlinearities of the windshield 14 generating an audible message 16 inside the approaching unequipped vehicle 8. Though a single approaching vehicle is illustrated as being detected by the sensing means, it is within the contemplation of the invention that any vehicle within the line of sight of the sensing means, whether it is the first, second or third vehicle in line from the sensing means, is detectable for the purposes of determining safety at a preselected location.

Figure 16:
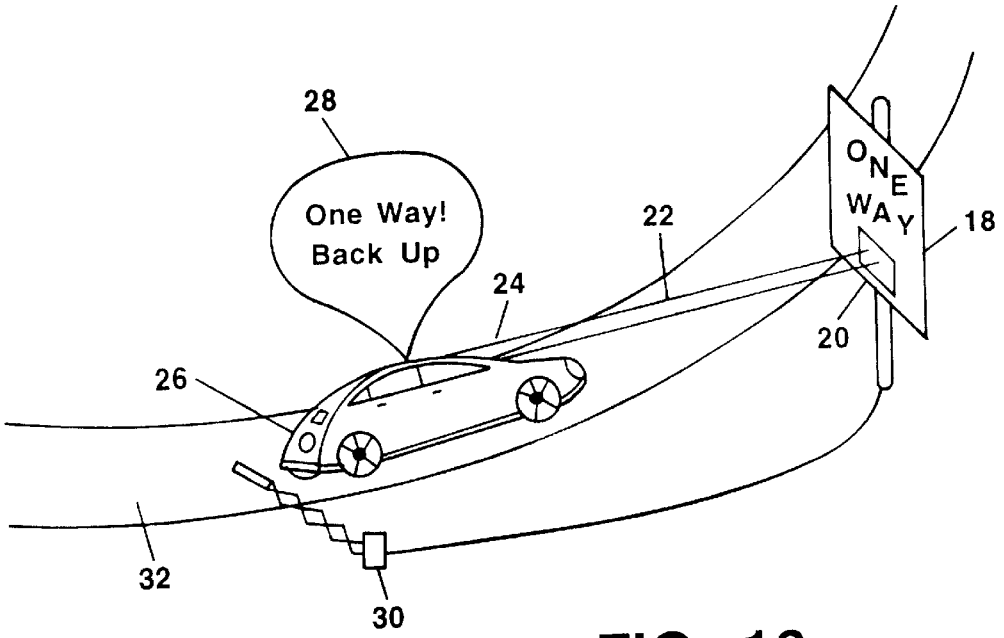
FIG. 16 pictorially represents a traffic sign equipped with a modulated-ultrasound projector communicating audible messages to the driver of the unequipped vehicle in accordance with this invention.

An alternative application, FIG. 16, illustrates a system 1 mounted on a traffic warning sign 18. The modulated-ultrasound projector 20 is mounted on the face of the sign 18. An ultrasound wave 22 is focused on the windshield 24 of the approaching vehicle 26. An audible message 28 is generated inside of the vehicle 26 by demodulation of the ultrasonic wave 22 as it interacts with nonlinearities of the windshield 24. The approach of the vehicle 26 is sensed by a magnetic loop detector 30 or the like implanted in the roadway 32. A radar system, television camera or other range sensing means could also be used.

Figure 17:
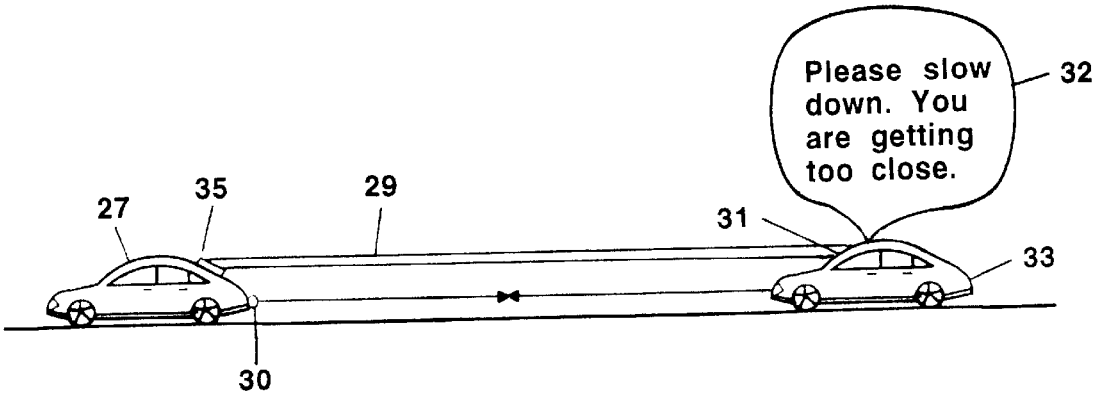
FIG. 17 pictorially represents a leading vehicle using an ultrasound wave in accordance with this invention to communicate to a trailing vehicle.

Another alternative application, FIG. 17, illustrates the mounting of an ultrasound projector 35 on the rear of a land vehicle 27 in order to communicate with a trailing vehicle 33 via an ultrasonic wave 29. Communications can be automatically issued by a radar system 30 that detects the distance to and approach speed of the trailing vehicle 33 with, preferably, microwaves 32 or other waves. An audible message 32 is generated inside of the vehicle 33 by demodulation of the ultrasonic wave 29 as it interacts with nonlinearities of the windshield 31.

Additionally, the ultrasound projector illustrated in FIG. 17 can be place in the front of a vehicle (not shown), such as a police car, to transmit an audible message to a leading vehicle or an approaching vehicle.

Additionally, the ultrasound projector illustrated in FIG. 17 can also be place in the front and rear of a vehicle (not shown), such as a delivery truck, to transmit an audible message at a preselected range to warn pedestrians and other vehicles of the approaching vehicle, where the view of the vehicle is obstructed by buildings, trees, shrubs, or other vehicles. The range of the demodulated audible message is a function of the speed of the vehicle and the safe stopping distance of the vehicle at the speed of the vehicle plus an additional distance as a safety margin.

Figure 18:
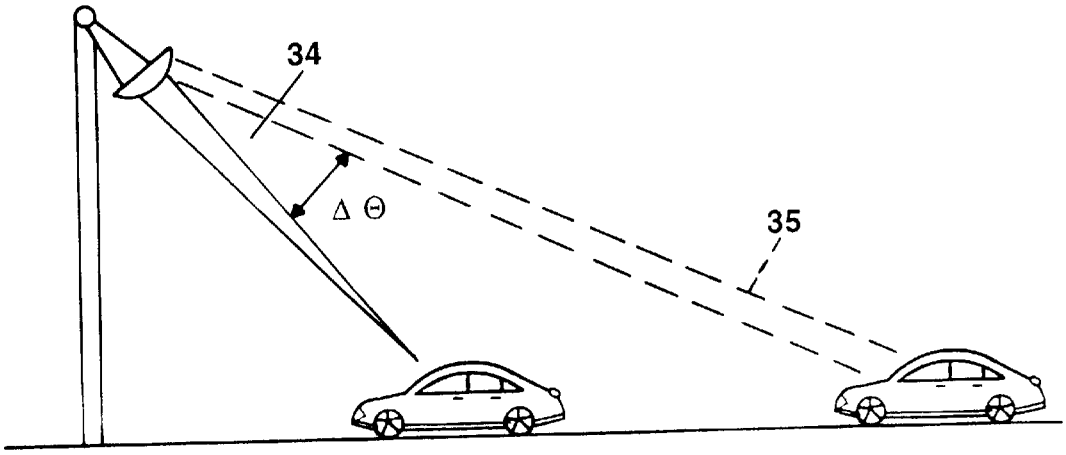
FIG. 18 pictorially represents wave steering with either phased-array or mechanical steering means of this invention. Steering could be in either elevation or azimuth or both.

Yet another application, FIG. 18, illustrates the ultrasound wave 34 being steered using either conventional mechanical means or electronic phased-array techniques. The steering commands come from the computer (not shown) analyzing the radar returns 35 or data from another range sensing system.

Figure 19:
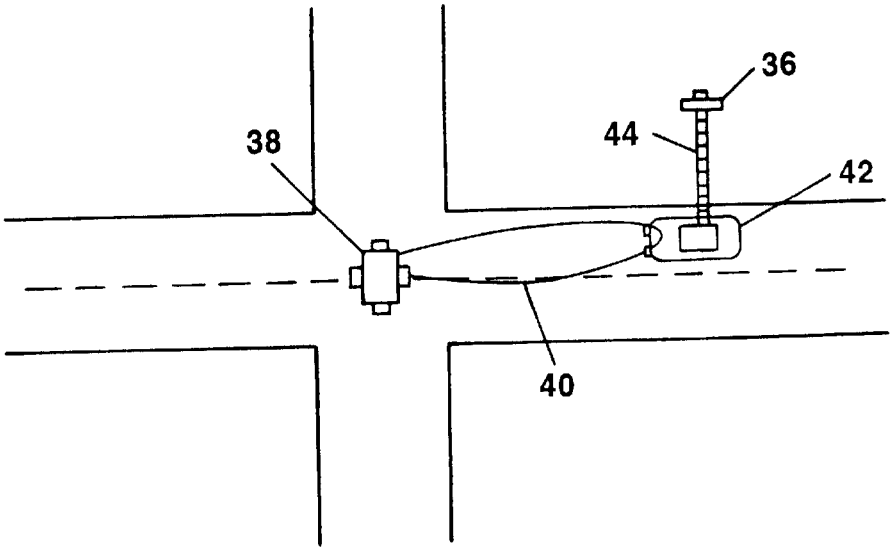
FIG. 19 illustrates pictorially a remote ultrasound projector triggered by the radar range sensor of this invention located at an intersection.

A further application, FIG. 19, illustrates the ultrasonic sound projection system 36 at a location remote from the intersection traffic signal 38. The approaching vehicle 42 is monitored by a radar wave 40. A message is communicated to the remote ultrasonic sound projection system 36 that transmits an ultrasonic wave 44 against the vehicle 42 side, rear or front glass. An audible message is generated inside of the vehicle 42 by the nonlinear interaction of the ultrasound wave 44 with the window of vehicle 42.

Figure 20:
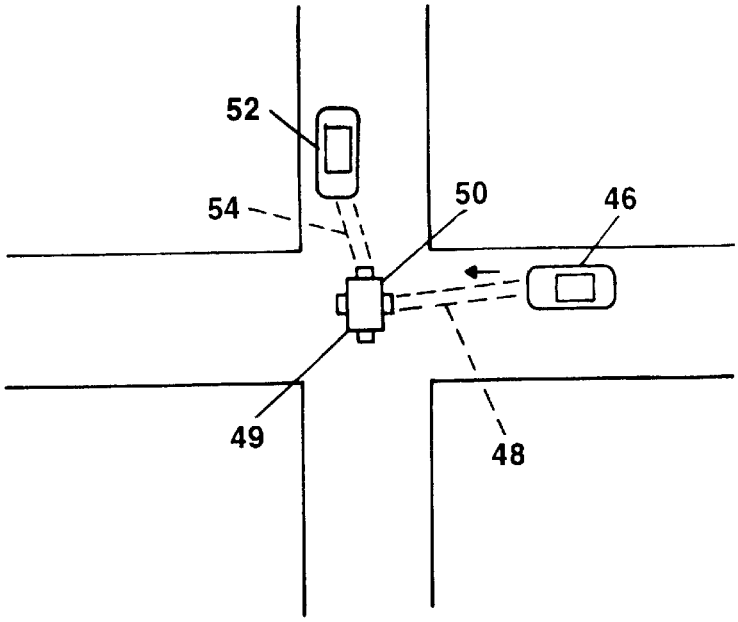
FIG. 20 pictorially represents a modulated-ultrasound projector focused on cross traffic that might enter an intersection and be in the path of a dangerously approaching vehicle with the dangerous vehicle detected by the radar sensor mounted on the traffic control device in accordance with this invention.

FIG. 20 illustrates a dangerously approaching vehicle 46 whose progress is monitored by a radar-type range sensor's wave 48 emanating from the traffic light 49. An analysis of the time history of the approaching vehicle's range is carried out by a conventional digital computer running the programming flow chart of FIG. 7. This analysis shows that it is unlikely that vehicle 46 will stop before the light 50 at the intersection changes to red. A warning carried by an ultrasound wave 54 is then issued to a vehicle 52 that might enter the intersection and be in the path of the dangerously approaching vehicle 46.

Figure 21:
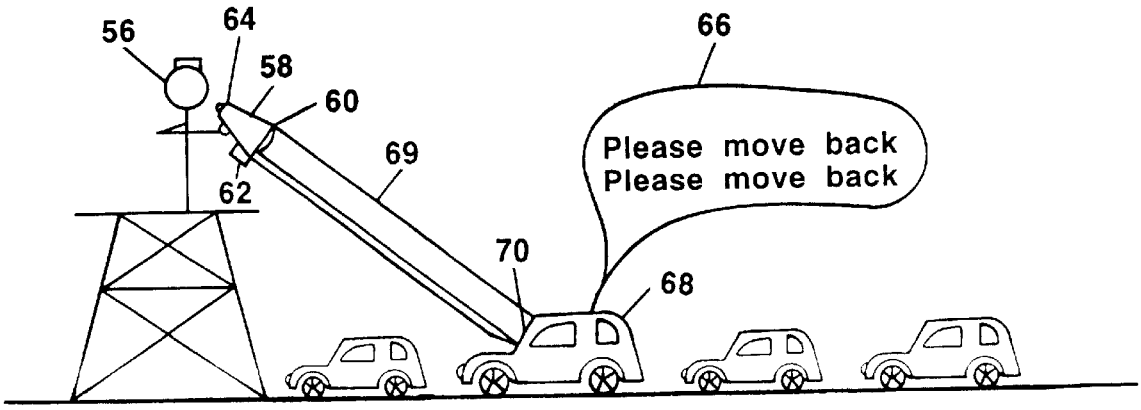
FIG. 21 is a pictorial representation of a modulated-ultrasound megaphone that an official is using to focus his voice on a particular vehicle among many in accordance with this invention.

FIG. 21 shows a sound generator 58 in use by a public safety official 56 to communicate with one vehicle 68 among many. An example would be a multilane toll plaza or a large parking lot. In this case the megaphone-like sound generator 58 consists of the sound generating array 60, a range and direction sensor (which maybe a microwave radar and/or TV camera) 62 and a microphone 64 for the user 56 to speak into. The measurements of the range sensor 62 are used to set the preprocessing parameters of the ultrasonic wave 69 so that audible sound 66 is generated inside the vehicle 68 by the ultrasonic wave 69 being demodulated by the windshield 70.

Figure 22:
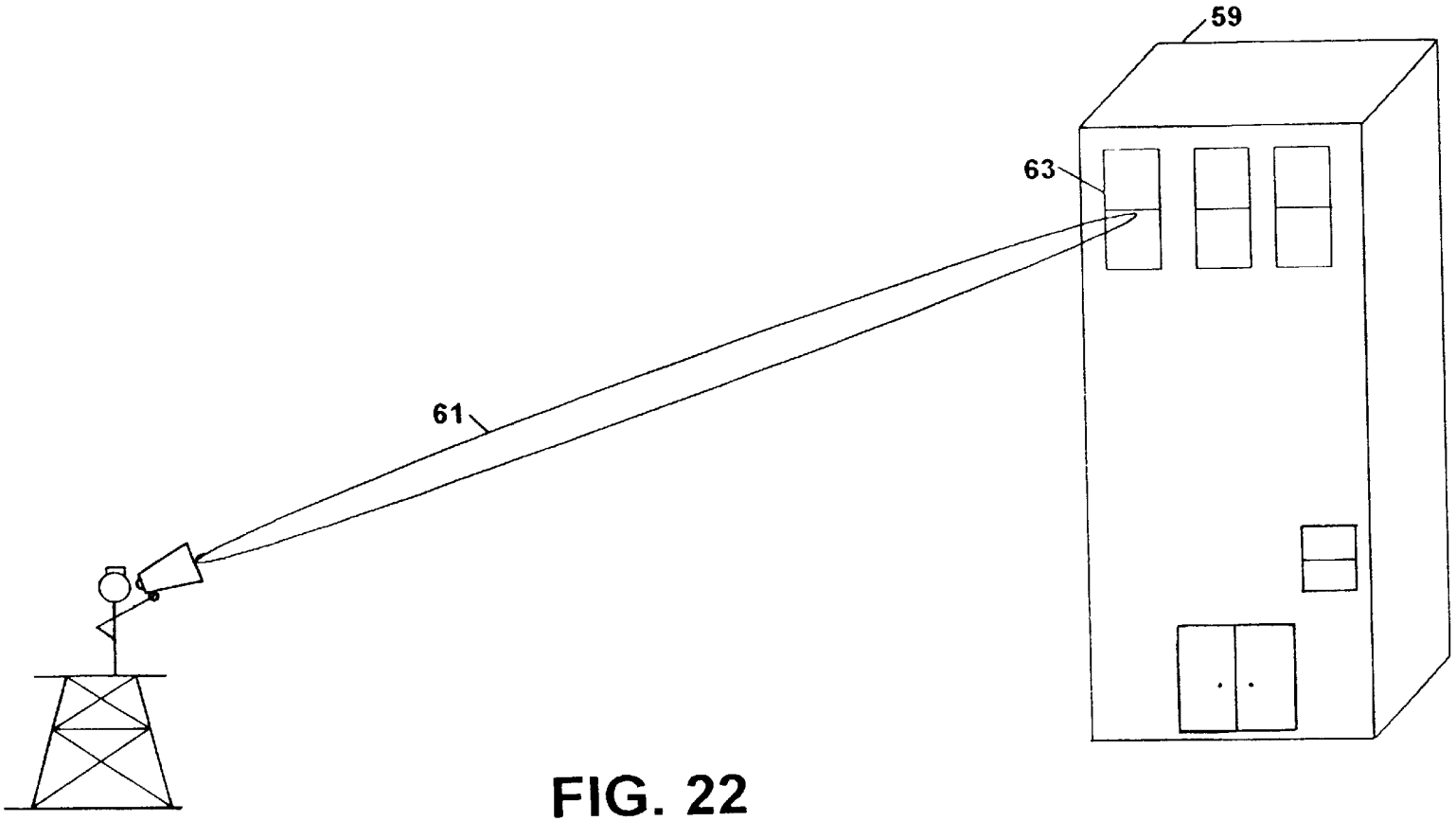
FIG. 22 is a pictorial representation of a public official communicating with people behind a window using focused modulated-ultrasound in accordance with this invention.

FIG. 22 shows a public safety application of the system 1. An official uses a megaphone device 57 to transmit an ultrasound wave 61 onto a window 63 of the building 59. An audible warning message is generated inside the building by the interaction of the ultrasound wave 61 and the window 63.

Returning to FIG. 11, the system 1 in use at a pedestrian crossing 72 whose crossing control light 73 is outfitted to assist, in particular, blind pedestrians 78. In this case the ultrasonic wave 74 interacts with the air and generates the audible sounds 76 near the blind pedestrian 78 using information from a distance and angle sensor 80 to set the parameters of the sound transmitter 82. An interesting characteristic of this embodiment is that the sound 76 is generated in the vicinity of the pedestrian 78 and not closer to the sound projector 82. This is accomplished by focusing multiple waves of sound on the targeted region as illustrated in FIGS. 14 and 15.

There are other embodiments, such as controlling a crowd, when sound generation in the air can be used.

Figure 23:
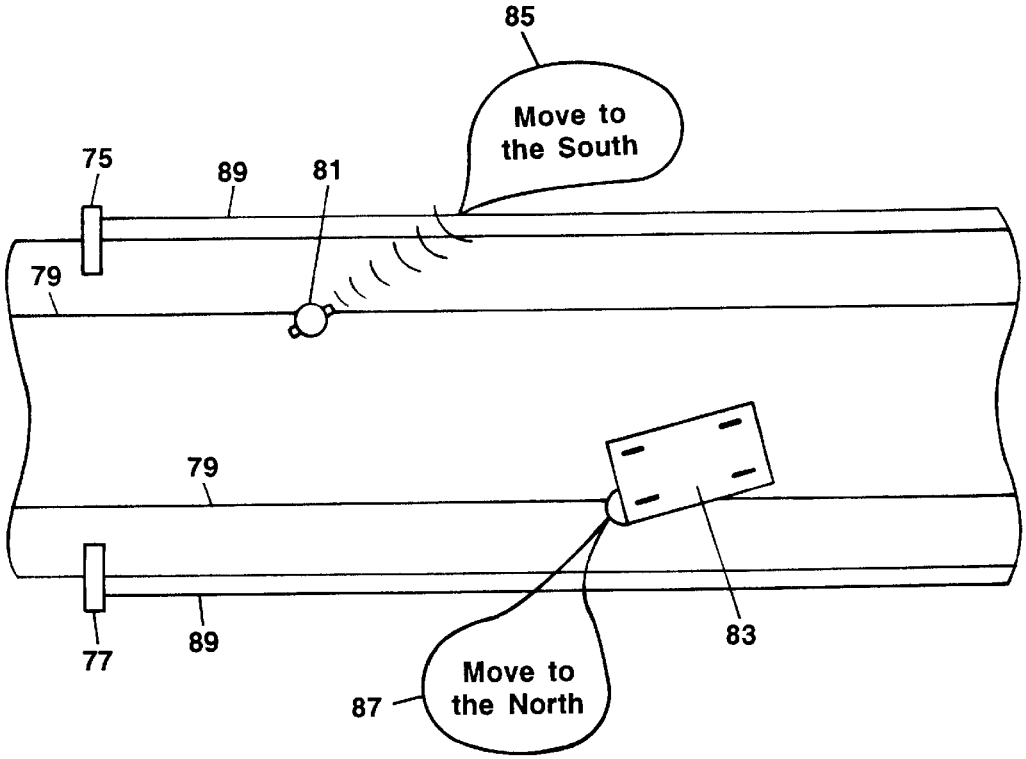
FIG. 23 pictorially illustrates a channel of movement whose boundaries are established by waves of modulated ultrasonic waves in order for pedestrians or vehicles entering the waves to receive instructions on how to move back into the channel.

Yet another application is illustrated in FIG. 23, where waves 89 of modulated ultrasound are projected by sensors 75 and 77 such that a pathway 79, or channel, is defined between the waves. The pathway 79 could include, but is not limited to, use by pedestrians, watercraft or land vehicles. Exiting the pathway 79 and entering one of the waves 89 results in a message 85, 87 directing the pedestrian 81 or vehicle 83 back in to the pathway 79 will be transmitted to the intruding object 81, 83. The messages 85 and 87 could be transmitted after a radar-type scanner has detected the intrusion of a wave 89, or the wave 89 can continuously transmit instruction for returning to the pathway 79 which will be heard whenever the very narrow waves 89 have been entered.

Now returning to FIG. 10, an additional feature to the present invention is a microphone 188 that monitors the transmissions and relays characteristics of the transmitted wave 184 back to the transmitting system 182. Should rain, snow, blowing sound, fog or other substances change the nonlinear properties of the air as described by Equation 2 or otherwise scatter the ultasonic waves 184, the transmitting system 182 would use the detected changes to modify the parameters of the transmission such as transmitter power, carrier frequency, degree of modulation and preprocessing filtering to compensate for the effects of the substances that have entered the path of the wave 184.

Yet another application of the present invention is aviation ground and air traffic control. Aircraft taxiing to and from the terminal, runway, and maintenance hanger can be contacted by the control tower (not shown) or specially equipped aircraft (not shown) with greater speed and accuracy than the current reliance on radio transmission and reception. In-flight near misses will be eliminated with aircraft equipped (not shown) with the present invention. Audio communication in the cockpit will no longer rely on the radio being turned on or being tuned to the correct frequency.

Although the invention has been described with respect to various embodiments, it should be realized this invention is also capable of a wide variety of further and other embodiments within the spirit and scope of the appended claims.

What is claimed is:

1. A audible communication system for use in conjunction with a vehicle for transporting at least one individual, comprising:

at least one sensor disposed within the vicinity of or at a preselected location for sensing information with respect to the vehicle as the vehicle approaches the preselected location and providing at least one signal indicative of said information;

at least one processor, said at least one processor capable of analyzing said at least one signal in order to provide at least one further signal indicative of vehicle performance characteristics and further information about the vehicle; and means for receiving said at least one further signal from said at least one processor and for transmitting an audible message within the vehicle without electronic receiving equipment to the at least one individual within the vehicle in order to provide information relative to at least the prevention of accidents at or within the vicinity of the preselected location to the at least one individual.

2. An audible communication system for use in conjunction with a vehicle for transporting at least one individual, comprising:

at least one sensor disposed within the vicinity of or at a preselected location for sensing information with respect to the vehicle as the vehicle approaches the preselected location and providing at least one signal indicative of said information;

at least one processor, said at least one processor capable of analyzing said at least one signal in order to provide at least one further signal indicative of characteristics of the vehicle; and a communication device for receiving said at least one further signal from said at least one processor and for audibly communicating through a glass portion of the vehicle with the at least one individual within the vehicle in order to provide said information with respect to the vehicle to the at least one individual.

3. A system as defined in claim 2, wherein said information includes a reflective signature of the vehicle indicative of the make, model and year of the vehicle;

wherein said at least one at least one processor analyses said reflective signature to determination window angle, window thickness, and window material of the vehicle; and wherein said at least one further signal takes into consideration the refractive and reflective characteristics of the window of the vehicle such that said at least one further signal is audible by the at least one individual of the vehicle as said at least one further signal passes through the window of the vehicle.

4. An audible communication system for use in conjunction with a vehicle, comprising:

at least one sensor disposed adjacent to or at a preselected location for sensing an approaching vehicle and for producing at least one signal indicative of the sensed vehicle;

at least one processor operably connected to said at least one sensor, said at least one processor being capable of analyzing said at least one signal from said at least one sensor indicative of the sensed vehicle to determine an appropriate course of action of the sensed vehicle and/or the condition adjacent to or at the preselected location; and a vehicle signaling device associated with the preselected location and in proximity to said at least one sensor, said vehicle signaling device being controlled by said at least one processor to provide an audible message to the sensed vehicle without electronic receiving equipment concerning course of action of the sensed vehicle or the conditions adjacent to or at the preselected location.

5. The system as claimed in claim 4, wherein said at least one signal of the sensed vehicle further includes a vehicle type of the sensed vehicle, wherein said at least one processor analyses of said at least one signal determines window angle, window thickness, and window material of the sensed vehicle, wherein said at least one processor utilizes refractive and reflective characteristics of a window of the sensed vehicle to select said audible message from a preprogrammed listing such that said audible message is audible within the sensed vehicle as said audible message passes through the window of the sensed vehicle.

6. The system as claimed in claim 5, wherein said vehicle type includes make, model and year.

7. The system as claimed in claim 4, wherein said at least one sensor is an above-road sensor.

8. The system as claimed in claim 4, wherein said at least one sensor is a road-imbedded sensor.

9. The system as claimed in claim 4, wherein said at least one processor determines a range time history of the sensed vehicle from the preselected location and an appropriate course of action for the sensed vehicle and transmits at least one further signal to said vehicle signaling device, causing said vehicle signaling device to provide said audible message to the sensed vehicle concerning an appropriate course of action for the sensed vehicle and/or conditions adjacent to or at the preselected location.

10. The system as claimed in claim 4, wherein said vehicle signaling device includes at least one ultrasonic projector, wherein said at least one ultrasonic projector generates at least one modulated wave directed toward the sensed vehicle, wherein said at least one modulated wave carries said audible message, wherein said audible message demodulates from said at least one modulated wave when said at least one modulated wave interacts with a glass portion of the sensed vehicle, wherein said audible message is selected from a preprogrammed list based on preselected location specific information and said analyzed data of said at least one signal from said at least one sensor indicative of the sensed vehicle.

11. The system as claimed in claim 10, wherein said preselected location specific information includes an intersection or a curve.

12. The system as claimed in claim 10 further comprising an atmospheric monitor capable of providing a signal to said at least one processor of changes in atmospheric conditions that will impact the demodulation of said audible message, whereby said at least one processor transmits said at least one modulated wave having a waveform to compensate for the atmospheric conditions.

13. The system as claimed in claim 10, wherein said vehicle signaling device signals a plurality of sensed vehicles.

14. The system as claimed in claim 4, wherein said at least one sensor comprises:

a radar device for sensing the approaching vehicle and producing said at least one signal indicative of the sensed vehicle;

an analog-to-digital converter for converting said at least one signal to digital representations prior to processing; and a comparator for indicating detection of the sensed vehicle when said digital representation exceeds a predetermined threshold.

15. The system as claimed in claim 14, wherein said comparator is a processor-based program.

16. The system as claimed in claim 14, wherein said radar device comprises an antenna and a transceiver.

17. The system as claimed in claim 4, wherein said vehicle signaling device comprises at least one ultrasonic projector, wherein said at least one ultrasonic projector generates a modulated wave directed toward the sensed vehicle, wherein said modulated wave carries said audible message, wherein said audible message demodulates from said modulated wave when said modulated wave interacts with a glass portion of the sensed vehicle, wherein said at least one processor selects said audible message based on information programmed into said at least one processor.

18. A method of using an audible communication system associated with a preselected location comprising the steps of:

obtaining information about a vehicle derived from at least one signal from at least one sensor disposed within the vicinity of or at a preselected location for sensing information with respect to the vehicle as the vehicle approaches the preselected location;

providing at least one signal indicative of the sensed vehicle information;

analyzing the at least one signal from the at least one sensor which is indicative of the sensed vehicle;

matching the sensed vehicle information with stored vehicle information;

analyzing the sensed vehicle information and the stored vehicle information in view of site specific information;

determining conditions at the preselected location; and operating the vehicle signaling device disposed within the vicinity of or at the preselected location to transmit an audible message regarding the conditions at the preselected location and/or a course of action for the sensed vehicle without electronic receiving equipment.

19. The method as claimed in claim 18 wherein the specific site comprises a curve, and the method further includes the steps of:

disposing the at least one sensor and the vehicle signaling device upstream of the curve;

computing the appropriate safe speed which is a threshold speed for the vehicle to prevent the vehicle from rolling over; and estimating the actual speed of the vehicle at a specific point of curvature of the curve.

20. The method as claimed in claim 18 wherein the specific site is an intersection, and the method further includes the steps of:

disposing the audible communication system at or adjacent to a traffic-signal controlled intersection;

computing, by the at least one processor, from information, the actual speed of the vehicle and a stopping distance to enable the vehicle to stop at a preselected time;

computing, by the at least one processor, the actual speed of the vehicle at a distance upstream from the intersection;

determining, by the at least one processor, whether the vehicle will be able to stop at the preselected time before it reaches the intersection; and sending, by the at least one processor, from the determination, a signal to the vehicle signaling device to transmit an audible message to an interior of the vehicle.

21. An audible communication system for a person approaching a specific site, comprising:

at least one sensor disposed adjacent a crosswalk having a crossing light for sensing the person within the crosswalk for producing at least one signal indicative of the sensed person;

at least one processor operably connected to said at least one sensor and to the crossing light, said at least one processor for analyzing said at least one signal from said at least one sensor indicative of the sensed person and the crossing light, to determine the position of the sensed person within the crosswalk, and to determine the status of the crossing light; and a signaling device associated with the crosswalk and disposed adjacent the crosswalk in proximity to said at least one sensor, said signaling device being controlled by said at least one processor to provide a warning to the sensed person concerning the status of the crossing light, wherein said signaling device is at least one ultrasonic projector, wherein said ultrasonic projector is directed toward the sensed person for generating a plurality of modulated waves, wherein said plurality of modulated waves demodulate to an audible message as said plurality of modulated waves reaches a focal point of said plurality of modulated waves.

22. An audible communication system for communicating between vehicles, comprising:

at least one sensor disposed within a first vehicle for producing at least one signal indicative of a second vehicle;

at least one processor operably connected to said at least one sensor, said at least one processor for analyzing said at least one signal from said at least one sensor indicative of the second vehicle;

a signaling device disposed on or within the first vehicle, said signaling device being controlled by said at least one processor to provide an audible message to the second vehicle; and said signaling device includes at least one ultrasonic projector, wherein said at least one ultrasonic projector generates at least one modulated wave directed toward the second vehicle, wherein said at least one modulated wave carries said audible message, wherein said audible message demodulates from said at least one modulated wave when said at least one modulated wave interacts with a glass portion of the second vehicle, wherein said at least one processor determines the performance characteristics of the second vehicle and an appropriate course of action for the second vehicle based on site-specific information programmed into said at least one processor.

23. An audible communication system for communicating between a person and a vehicle, comprising:

a device having at least one sensor disposed therein for producing at least one signal indicative of the vehicle;

at least one processor operably connected to said at least one sensor, said at least one processor for analyzing said at least one signal from said at least one sensor indicative of the sensed vehicle, to determine the position of the sensed vehicle relative to the person, and to determine a vehicle classification of the sensed vehicle;

a signaling device disposed on or within said device, said signaling device being controlled by said at least one processor to provide an audible message to the sensed vehicle; and said signaling device comprises at least one ultrasonic projector, wherein said at least one ultrasonic projector generates at least one modulated wave directed toward the sensed vehicle, wherein said modulated wave carries said audible message, wherein said audible message demodulates from said at least one modulated wave when said at least one modulated wave interacts with a glass portion of the sensed vehicle, wherein said at least one processor determines the sensed vehicle characteristics and selects an audible message that matches an appropriate waveform to be intelligible within the sensed vehicle.

24. The system as claimed in claim 23, wherein said device is capable of being handheld.

25. An audible communication system for communicating with an object within a pathway, comprising:

plurality of sensors disposed adjacent to boundaries of the pathway for producing at least one signal indicative of the sensed object;

at least one processor operably connected to each said plurality of sensors, said at least one processor for analyzing said at least one signal from said plurality of sensors indicative of the sensed object to determine the position of the sensed object with respect to at least one said plurality of sensors;

a signaling device disposed adjacent to boundaries of the pathway, said signaling device being controlled by said at least one processor to provide an audible message to the sensed object; and said signaling device comprises at least one ultrasonic projector, wherein said at least one ultrasonic projector generates at least one modulated wave directed toward the sensed object, wherein said at least one modulated wave carries said audible message, wherein said audible message demodulates from said at least one modulated wave when said modulated wave interacts with a glass portion of the sensed object or demodulates in air in the proximity of the sensed object, wherein said at least one processor determines the distance to the sensed object and selects an audible message that matches an appropriate waveform for said audible message to demodulate as said at least one modulated wave reaches the sensed object.

26. The audible communication system as defined in claim 25, wherein the sensed object is a water vessel.

27. The audible communication system as defined in claim 25, wherein the sensed object is a person.

28. The audible communication system as defined in claim 25, wherein the sensed object is a land vessel.

29. The audible communication system as defined in claim 25, wherein the sensed object is an aircraft.

30. An audible communication system for communicating between a person operating said system and occupants in a room of a building, comprising:

a device having at least one sensor disposed therein for producing at least one signal indicative of a window of the building;

at least one processor operably connected to said at least one sensor, said at least one processor for analyzing said at least one signal from said at least one sensor indicative of the sensed window, to determine the position of the sensed window of the room of the building relative to the person operating said system;

a signaling device disposed on or within said device, said signaling device being controlled by said at least one processor to provide an audible message to the occupants in the room of the building;

said signaling device comprises at least one ultrasonic projector, wherein said ultrasonic projector generates at least one modulated wave directed toward the sensed window, wherein said at least one modulated wave carries said audible message, wherein said audible message demodulates from said at least one modulated wave when said at least one modulated wave interacts with sensed window; and said at least one processor determines characteristics of the sensed window and selects an audible message that matches an appropriate waveform for said audible message to be intelligible within the room of the building.

31. The system as claimed in claim 30 wherein said window characteristics include a window angle, a window thickness, and a window material.

32. The system as claimed in claim 30, wherein said device is capable of being handheld.

33. An audible communication system comprising:

at least one wave projector means for generating as a primary wave an ultrasonic wave, said ultrasonic wave interacts with a nonlinear medium wherein a secondary wave at an audible frequency is produced;

wherein said at least one wave projector means comprising a plurality of individual units operably connected together for emitting said primary wave;

aiming means operably connected to each of said units for changing the direction of said ultrasonic wave for positioning a focal point on the non-linear medium;

ultrasonic wave focussing means for providing coordinates of the non-linear medium to said aiming means to adjust said units; and wherein said ultrasonic wave focussing means comprising a microwave radar device.

34. The system as defined in claim 33, wherein said aiming means comprising at least one phase-shifter and at least one power amplifier.

35. The system as defined in claim 33, wherein said ultrasonic wave is a carrier wave modulated by a message, wherein said message is selected from a processor-based matrix of the nonlinear medium characteristics.

36. The system as defined in claim 33, wherein the non-linear medium is an automobile, aircraft or watercraft windshield.

37. The system as defined in claim 33, wherein the non-linear medium is air in the proximity of a person.

38. The system as defined in claim 33, wherein the non-linear medium is a building window.

39. The system as defined in claim 33, further comprising at least two ultrasonic wave projector means defining a pathway or a channel, whereby said ultrasonic wave is directed towards the non-linear medium when the non-linear medium drifts outside the pathway or the channel.

40. The system as defined in claim 33, wherein said ultrasonic wave focussing means comprises:

an antenna;

a transceiver;

an analog-to-digital converter; and a general-purpose digital computer networked together.

41. The system as defined in claim 40, wherein said antenna is a microwave antenna and said transceiver is a microwave transceiver.

42. The system as defined in claim 40, wherein said antenna is a laser light emitter and said transceiver is a laser transceiver.

43. The system as defined in claim 40, wherein said antenna is a radio antenna and said transceiver is a radio transceiver.

44. The system as defined in claim 40, wherein said antenna is an acoustic antenna and said transceiver is an acoustic transceiver.

45. The system as defined in claim 33, wherein said at least one wave projector means comprises:

a general purpose digital computer with storage;

a digital-to-analog converter; and an amplifier operably connected to each other.

46. A method of using non-linear output for generating an audible message to at least one individual within an approaching vehicle comprising the steps of:

generating an output radar wave directed towards a roadway;

detecting a returning radar wave of the output radar wave after being reflected off the approaching vehicle;

converting the returning radar wave from an analog to a digital signal;

comparing the characteristics of the digital signal with stored information with respect to the vehicle;

determining an appropriate waveform for selecting a digital message;

computing whether the vehicle will stop before reaching a predetermined position;

converting the digital message to an analog signal; and transmitting the analog signal to the approaching vehicle, whereby the analog signal is demodulated upon interacting with the glass portion of the approaching vehicle to the audible message.

47. A method of transmitting an audible message to at least one person located in a passenger compartment of a vehicle located at a distance from a sound projector comprising the steps of:

detecting distance of the vehicle from a predetermined location; and transmitting a modulated signal in the direction of the vehicle indicative of the distance of the vehicle from a predetermined location, wherein the modulated signal is of a prescribed waveform such that as the modulated signal interacts with a glass portion of the vehicle an audible message is produced inside the passenger compartment.

48. An audible communication system comprising:

range sensing means for determining the distance and speed of an approaching vehicle; and ultrasonic sound projection means in communication with said range sensing means, wherein said ultrasonic projector generates a modulated wave directed toward the vehicle, wherein said modulated wave carries an audible message, wherein said audible message demodulates from said modulated wave when said modulated wave interacts with a glass portion of the vehicle.

49. The system as defined in claim 48, wherein said ultrasonic sound projection means comprises, a general purpose digital computer, with storage to store modulated waves, to process data communicated by said range sensing means and to generate said modulated wave;

a digital-to-analog converter;

an amplifier; and at least one ultrasonic sound projection means for directing said modulated wave generated by said digital computer operably connected to each other.

50. An audible communication system comprising:

ultrasonic wave projector means for generating as a primary wave an ultrasonic wave modulated by an audible message;

wherein said ultrasonic wave projector means comprises a plurality of individual units together defining an array; and means for moving said units relative to each other to thereby vary the focal point of converging said ultrasonic waves upon a non-linear medium.

51. An intersection audible communication system attached to a traffic light comprising:

a vehicle detection apparatus; and an ultrasonic wave generator in communication with said vehicle detection apparatus, wherein said ultrasonic wave generator generates an ultrasonic wave as a primary wave wherein a secondary wave at an audible frequency is produced when said primary wave interacts with a nonlinear medium.

52. A system as defined in claim 51, wherein said vehicle detection apparatus comprises:

a radar antenna;

a transceiver;

an analog-to-digital converter; and a general-purpose digital computer operably connected to each other.

53. A system as defined in claim 51, wherein said ultrasonic wave generator comprises:

a general purpose digital computer with storage to store a plurality of primary waves and a processor to process vehicle information provided by said vehicle detecting apparatus, said processor generating said primary wave;

a digital-to-analog converter;

an amplifier; and at least one ultrasonic sound projector for directing said primary wave generated by said processor operably connected to each other.

54. An audible communication system for use in conjunction with a vehicle for transporting at least one individual, comprising at least one sensor disposed within the vicinity of or at a preselected location for sensing information with respect to a plurality of approaching vehicles to the preselected location and providing at least one signal indicative of said information for each vehicle of the plurality of approaching vehicles;

at least one processor, said at least one processor capable of analyzing said at least one signal in order to provide at least one further signal indicative of characteristics for each vehicle of the plurality of approaching vehicles; and a communication device for receiving said at least one further signal from said at least one processor and for audibly communicating through a glass portion of each of the plurality of vehicles with the at least one individual within each vehicle in order to provide a message to the at least one individual.

55. The system as claimed on claim 54, wherein said at least one sensor detects each vehicle of the plurality of vehicles within a line of sight of said at least one sensor, whereby all vehicles in line are detectable.

56. An audible communication system in conjunction with a vehicle for warning an approaching vehicle and/or pedestrian, comprising:

at least one sensor disposed on or within the vehicle for producing at least one signal indicative of the actual speed of the vehicle;

at least one processor operably connected to said at least one sensor, said at least one processor analyzes said at least one signal from said at least one sensor, wherein said at least one processor determines a maximum safe stopping distance for the vehicle and generates a modulated wave directed outward from the vehicle to warn of possible collision;

at least one signaling device disposed on or within the vehicle, said at least one signaling device being controlled by said at least one processor to direct said modulated wave to the approaching vehicle and/or pedestrian;

wherein said modulated wave carries an audible message; and wherein said audible message demodulates from said modulated wave when said modulated wave interacts with a glass portion of the approaching vehicle or in the air adjacent to the pedestrian.

57. An audible communication system for communicating between a vehicle and a living being, comprising:

at least one sensor disposed on or within the vehicle for producing at least one first signal indicative of the vehicle performance characteristics;

at least one processor disposed on or within the vehicle being operably connected to said at least one sensor, said at least one processor being capable of analyzing said at least one first signal, said at least one processor being further capable of generating at least one second signal indicative of a carrier waveform based on the vehicle performance characteristics; and at least one ultrasonic projector disposed on or within the vehicle, said at least one ultrasonic projector being controlled by said at least one processor, said at least one ultrasonic projector being further capable of analyzing said at least one second signal and generating at least one modulated wave for carrying an audible message a predetermined distance from the vehicle;

whereby the living being is capable of hearing said audible message when positioned at or near said predetermined distance from the vehicle.

58. An audible communication system for communicating between a vehicle and a living being, comprising:

at least one sound projector disposed on or within the vehicle being capable of generating at least one modulated wave; and said at least one modulated wave comprising an inaudible carrier wave and an audible message, said inaudible carrier wave being capable of carrying said audible message a predetermined distance from the vehicle, and said audible message being capable of demodulation from said inaudible carrier wave at said predetermined distance;

whereby the living being is capable of hearing said audible message when positioned at or near said predetermined distance from the vehicle.

59. An audible communication system for communicating with an object within a pathway, comprising at least one sensor disposed in a proximity of the pathway for producing at least one signal indicative of the object and further being capable of generating at least one modulated wave, wherein said at least one modulated wave comprises an inaudible carrier wave and an audible message, wherein said audible message demodulates from said inaudible carrier wave when said modulated wave interacts with a glass portion of the object or demodulates in air in the proximity of the object.

* * * * *